United States Patent [19]

Hirano et al.

[11] Patent Number: 4,694,784

[45] Date of Patent: Sep. 22, 1987

[54] COOLING SYSTEM FOR AUTOMOTIVE ENGINE OR THE LIKE

[75] Inventors: Yoshinori Hirano, Yokohama; Takao Kubozuka, Yokosuka, both of Japan

[73] Assignee: Nissan Motor Co., Ltd., Yokohama, Japan

[21] Appl. No.: 849,115

[22] Filed: Apr. 7, 1986

[30] Foreign Application Priority Data

Apr. 24, 1985 [JP] Japan ..... 60-88266

[51] Int. Cl.[4] ..... F01P 3/22

[52] U.S. Cl. ..... 123/41.12; 123/41.21; 123/41.27; 123/41.49

[58] Field of Search ..... 123/41.2–41.27, 123/41.49, 41.12

[56] References Cited

U.S. PATENT DOCUMENTS 4,549,505 10/1985 Hirano ..... 123/41.12
4,574,747 3/1986 Hirano ..... 123/41.27
4,577,594 3/1986 Hayashi et al. ..... 123/41.21

FOREIGN PATENT DOCUMENTS 2455174 12/1980 France ..... 123/41.49

*Primary Examiner*—William A. Cuchlinski, Jr.
*Attorney, Agent, or Firm*—Schwartz, Jeffery, Schwaab, Mack, Blumenthal & Evans

[57] ABSTRACT

In order to prevent wasteful cooling fan energization when the radiator or condensor of an evaporative type cooling system is partially filled in a manner which hinders heat exchange promotion and defeats any merit derived by operating a fan at full power, the fan is operated at a lower level to reduce fan noise and power consumption.

22 Claims, 25 Drawing Figures

COOLING SYSTEM FOR AUTOMOTIVE ENGINE OR THE LIKE

BACKGROUND OF THE INVENTION

1. Field of the Invention

The present invention relates generally to an evaporative type cooling system for an internal combustion engine or like device wherein liquid coolant is permitted to boil and the vapor used as a vehicle for removing heat therefrom, and more specifically to such a system wherein the operation of a cooling fan or like device which varies the amount of heat exchange between the condensor (or radiator) and a cooling medium surrounding the same (such as the ambient atmosphere), is controlled in accordance with the amount of liquid coolant which is contained in the radiator and/or the current heat exchange requirements.

2. Description of the Prior Art

In currently used "water cooled" internal combustion engines such as shown in FIG. 1 of the drawings, the engine coolant (liquid) is forcefully circulated by a water pump, through a cooling circuit including the engine coolant jacket and an air cooled radiator. This type of system encounters the drawback that a large volume of water is required to be circulated between the radiator and the coolant jacket in order to remove the required amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having an 1800 cc displacement (by way of example) is operated full throttle, the cooling system is required to remove approximately 4000 Kcal/h. In order to achieve this, a flow rate of 167 liter/min (viz., $4000-60\times\frac{1}{4}$) must be produced by the water pump. This of course undesirably consumes several horsepower.

Further, the large amount of coolant utilized in this type of system renders the possibility of quickly changing the temperature of the coolant in a manner that instant coolant temperature can be matched with the instant set of engine operational conditions such as load and engine speed, completely out of the question.

FIG. 2 shows an arrangement disclosed in Japanese Patent Application Second Provisional Publication No. Sho. 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity.

This arrangement while eliminating the power consuming coolant circulation pump which plagues the above mentioned arragement, has suffered from the drawbacks that the radiator, depending on its position with respect to the engine proper, tends to be at least partially filled with liquid coolant. This greatly reduces the surface area via which the gaseous coolant (for example steam) can effectively release its latent heat of vaporization and accordingly condense, and thus has lacked any notable improvement in cooling efficiency.

Further, with this system in order to maintain the pressure within the coolant jacket and radiator at atmospheric level, a gas permeable water shedding filter 5 is arranged as shown, to permit the entry of air into and out of the system. However, this filter permits gaseous coolant to readily escape from the system, thereby inducing the need for frequent filling of the coolant level to maintain a full level of coolant.

A further problem with this arrangement is that some of the air, which is sucked into the coolant system as the engine cools, tends to dissolve in the water, whereby upon start up of the engine, the dissolved air tends to come out of solution and forms small bubbles in the radiator which adhere to the walls thereof and form an insulating layer. The undissolved air also tends to collect in the upper section of the radiator and inhibit the convection-like circulation of the vapor from the cylinder block to the radiator. This of course further deteriorates the performance of the device.

Moreover, with the above disclosed arrangement the possibility of varying the coolant temperature with load is prevented since the internal pressure of the system is constantly at atmospheric level.

European Patent Application Provisional Publication No. 0 059 423 published on Sept. 8, 1982 discloses another arrangement wherein liquid coolant in the coolant jacket of the engine is not forcefully circulated therein and is permitted to absorb heat to the point of boiling. The gaseous coolant thus generated is adiabatically compressed in a compressor to raise the temperature and pressure thereof and thereafter introduced into a heat exchanger (radiator). After condensing, the coolant is temporarily stored in a reservoir and recycled back into the coolant jacket via a flow control valve.

This arrangement has suffered from the drawback that when the engine is stopped and cools down, the coolant vapor condenses and induces sub-atmospheric conditions which tend to induce air to leak into the system. This air tends to be forced by the compressor along with the gaseous coolant into the radiator. Due to the difference in specific gravity, the air tends to rise in the hot environment while the coolant which has condensed moves downwardly. The air, due to this inherent tendency to rise, forms pockets of air which cause a kind of "embolism" in the radiator and which badly impair the heat exchange ability thereof. With this arrangement the provision of the compressor renders the control of the pressure prevailing in the cooling circuit for the purpose of varying the coolant boiling point with load and/or engine speed difficult.

U.S. Pat. No. 4,367,699 issued on Jan. 11, 1983 in the name of Evans (see FIG. 3 of the drawings) discloses an engine system wherein the coolant is boiled and the vapor is used to remove heat from the engine. This arrangement features a separation tank 6 wherein gaseous and liquid coolant are initially separated. The liquid coolant is fed back to the cylinder block 7 under the influence of gravity while the relatively dry gaseous coolant (steam for example) is condensed in a fan cooled radiator 8.

The temperature of the radiator is controlled by selective energizations of the fan 9 which maintains a rate of condensation therein sufficient to provide a liquid seal at the bottom of the device. Condensate discharged from the radiator via the above mentioned liquid seal is collected in a small reservoir-like arrangement 10 and pumped back up to the separation tank via a small constantly energized pump 11.

This arrangement, while providing an arrangement via which air can be initially purged to some degree from the system tends to, due to the nature of the arrangement which permits said initial non-condensible matter to be forced out of the system, suffer from rapid loss of coolant when operated at relatively high altitudes. Further, once the engine cools, air is relatively freely admitted back into the system. The provision of the bulky separation tank 6 also renders engine layout difficult.

Further, the rate of condensation in the condenser is controlled by a temperature sensor disposed on or in the condensor per se in a manner which holds the pressure and temperature within the system essentially constant. Accordingly, temperature variation with load is rendered impossible.

Japanese Patent Application First Provisional Publication No. Sho. 56-32026 (see FIG. 4 of the drawings) discloses an arrangement wherein the structure defining the cylinder head and cylinder liners are covered in a porous layer of ceramic material 12 and wherein coolant is sprayed into the cylinder block from shower-like arrangements 13 located above the cylinder heads 14. The interior of the coolant jacket defined within the engine proper is essentially filled with gaseous coolant during engine operation at which time liquid coolant is sprayed onto the ceramic layers 12.

However, this arrangement has proven totally unsatisfactory in that upon boiling of the liquid coolant absorbed into the ceramic layers, the vapor thus produced escapes toward and into the coolant jacket, inhibits the penetration of fresh liquid coolant into the layers and induces the situation wherein rapid overheating and thermal damage of the ceramic layers 12 and/or engine soon results. Further, this arrangement is of the closed circuit type and is plagued with air contamination and blockages in the radiator similar to the compressor equipped arrangement discussed above.

FIG. 7 shows an arrangement which is disclosed in U.S. Pat. No. 4,549,505 issued on Oct. 29, 1985 in the name of Hirano. The disclosure of this application is hereby incorporated by reference thereto.

For convenience the same numerals as used in the above mentioned Patent are also used in FIG. 7.

This arrangement while solving the drawbacks encountered with the previously disclosed prior art has itself suffered from the drawbacks that when the radiator is relatively full of liquid coolant, such as immediately after a cold engine start when the cooling circuit of the system is usually full of liquid coolant, or in very cold climates wherein the amount of heat exchanging surface area is reduced as compared with the operation in warmer environments, the increase in heat exchange promoted by the operation of the fan is very small no matter how powerfully the latter device is operated. Thus, under such conditions, the FIG. 7 device energizes the fan at the same level irrespective of the amount of liquid coolant in the radiator and irrespective of the magnitude of the difference between the desired and actual temperature, electrical energy is wastefully consumed and an unnecessarily high level of fan noise occurs without a corresponding increase in heat exchange being achieved.

SUMMARY OF THE INVENTION

It is an object of the present invention to provide an evaporative cooling system for an automotive internal combustion engine or like device wherein the operation of a cooling fan or similar device is controlled in response to the heat exchange capacity of the condensor or radiator of the system.

In brief, the above object is achieved by an arrangement wherein the level of coolant in the radiator is sensed, and if detected above a predetermined level, the voltage with which the fan is energized is reduced from a normal high level to a lower one.

More specifically, a first aspect of the present invention takes the form of a cooling system for an internal combustion engine or the like which has a structure subject to high heat flux, the system being characterized by a cooling circuit comprising: a coolant jacket disposed about the structure and into which coolant is introduced in liquid form, permitted to boil and discharged in gaseous form; a temperature sensor disposed in the coolant jacket for sensing the temperature of the coolant therein; a radiator in fluid communication with the coolant jacket and in which coolant vapor produced in the coolant jacket is condensed to its liquid form, the radiator having heat exchanging surfaces exposed to a cooling medium; means for returning liquid coolant from the radiator to the coolant jacket in a manner which maintains the level of coolant in the coolant jacket at a first predetermined level, the first predetermined level being selected to immerse the structure in a predetermined depth of liquid coolant; a first level sensor disposed in the radiator for sensing the level of liquid coolant being above a second predetermined level; a device for varying the amount of cooling medium which flows over the heat exchanging surfaces of the radiator; a control circuit responsive to the temperature sensor and the first level sensor, the control circuit being arranged to energize the device (a) at a first level in response to the temperature sensor indicating that the temperature of the coolant in the coolant jacket is above a desired target value and the level sensor indicating that the level of coolant in the radiator is above the second predetermined level and (b) at a second level in response to the temperature sensor indicating that the temperature of the coolant in the coolant jacket is above a desired target value and the level sensor indicating that the level of coolant in the radiator is below the second predetermined level.

A second aspect of the present invention comes in the form of a method of cooling an internal combustion engine having a structure subject high heat flux, characterized by the steps of: introducing liquid coolant into a coolant jacket disposed about the structure; permitting the coolant to absorb heat from the structure boil and produce coolant vapor; condensing the coolant vapor produced in the coolant jacket to its liquid form in a condenser; returning the liquid condensate formed in the radiator to the coolant jacket using coolant return means in a manner to maintain the level of liquid coolant in the coolant jacket at first predetermined level which is selected to maintain the structure immersed in a predetermined depth of liquid coolant; sensing the temperature of the coolant in the coolant jacket; sensing the level of coolant in the radiator at a second predetermined level; using a device to vary the rate of heat exchange between the heat exchanging surfaces of the radiator and a cooling medium; controlling the device in response to the temperature of the coolant in the coolant jacket and in response to the level of liquid coolant in the radiator.

BRIEF DESCRIPTION OF THE DRAWINGS

The features and advantages of the arrangement of the present invention will become more clearly appreciated from the following description taken in conjunction with the accompanying drawings in which:

FIGS. 9A, 9B, 9C to 22A and 22B show flow charts which depict the control steps executed in the third embodiment.

DETAILED DESCRIPTION OF THE PREFERRED EMBODIMENTS

Before proceeding with the description of the embodiment of the present invention, it is deemed appropriate to discuss some of the basic features of the type of cooling system to which the present invention is directed.

Figure 1:
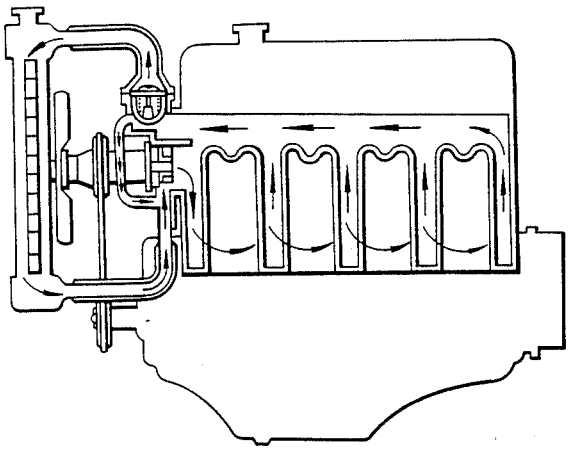
FIG.1 (PRIOR ART)
FIGS. 1 to 4 show the prior art arrangements discussed in the opening paragraphs of the instant disclosure.
Figure 2:
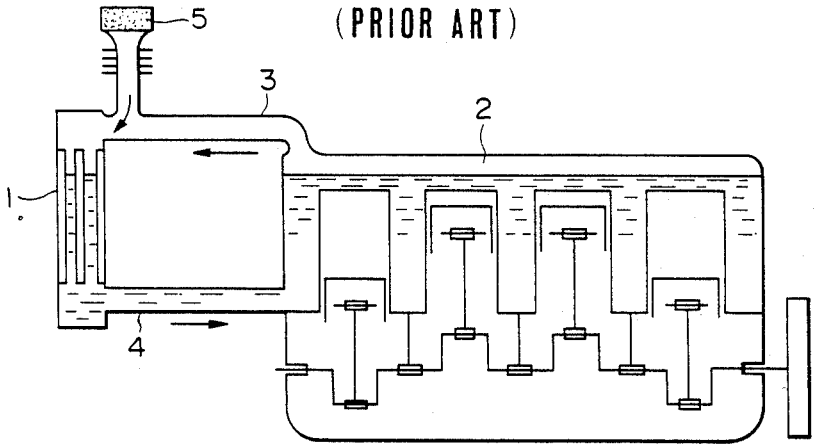
FIG.2 (PRIOR ART)
Figure 3:
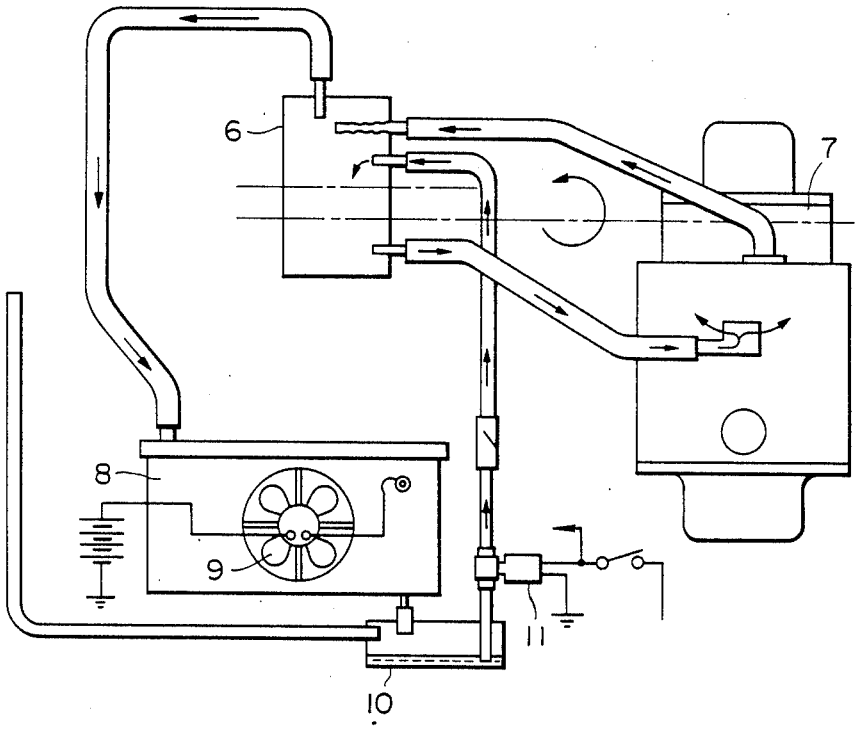
FIG.3 (PRIOR ART)
Figure 4:
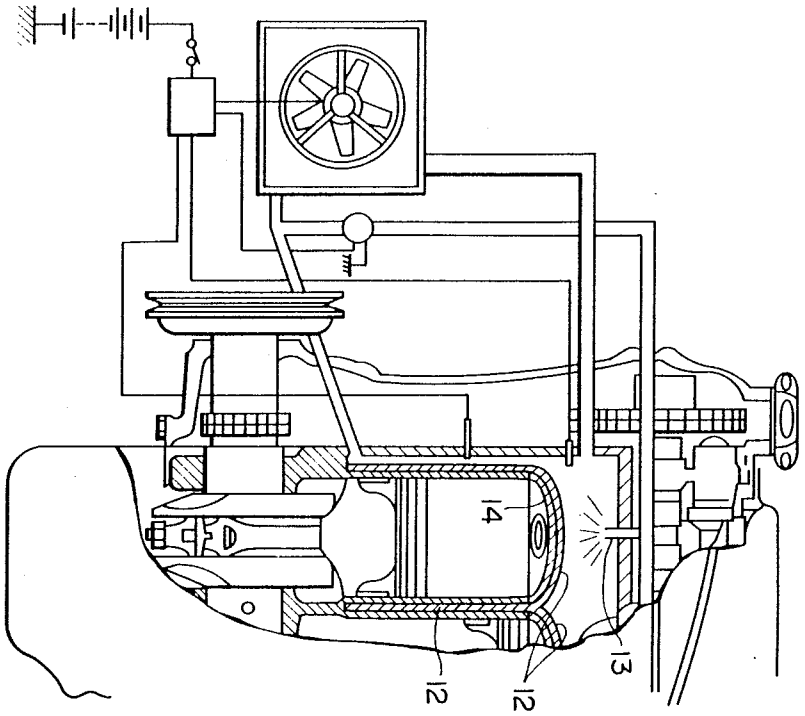
FIG.4 (PRIOR ART)
Figure 5:
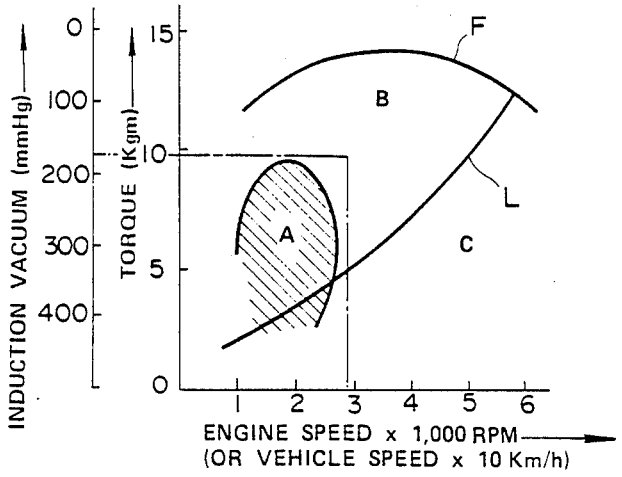
FIG. 5 is a diagram showing in terms of engine load and engine speed the various load zones which are encountered by an automotive internal combustion engine.
Figure 6:
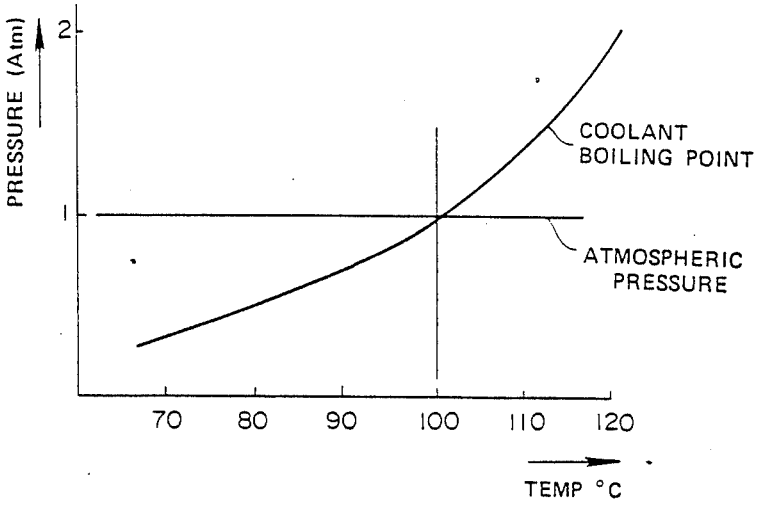
FIG. 6 is a graph showing in terms of pressure and temperature the changes in the coolant boiling point in a closed circuit type evaporative cooling system.
Figure 7:
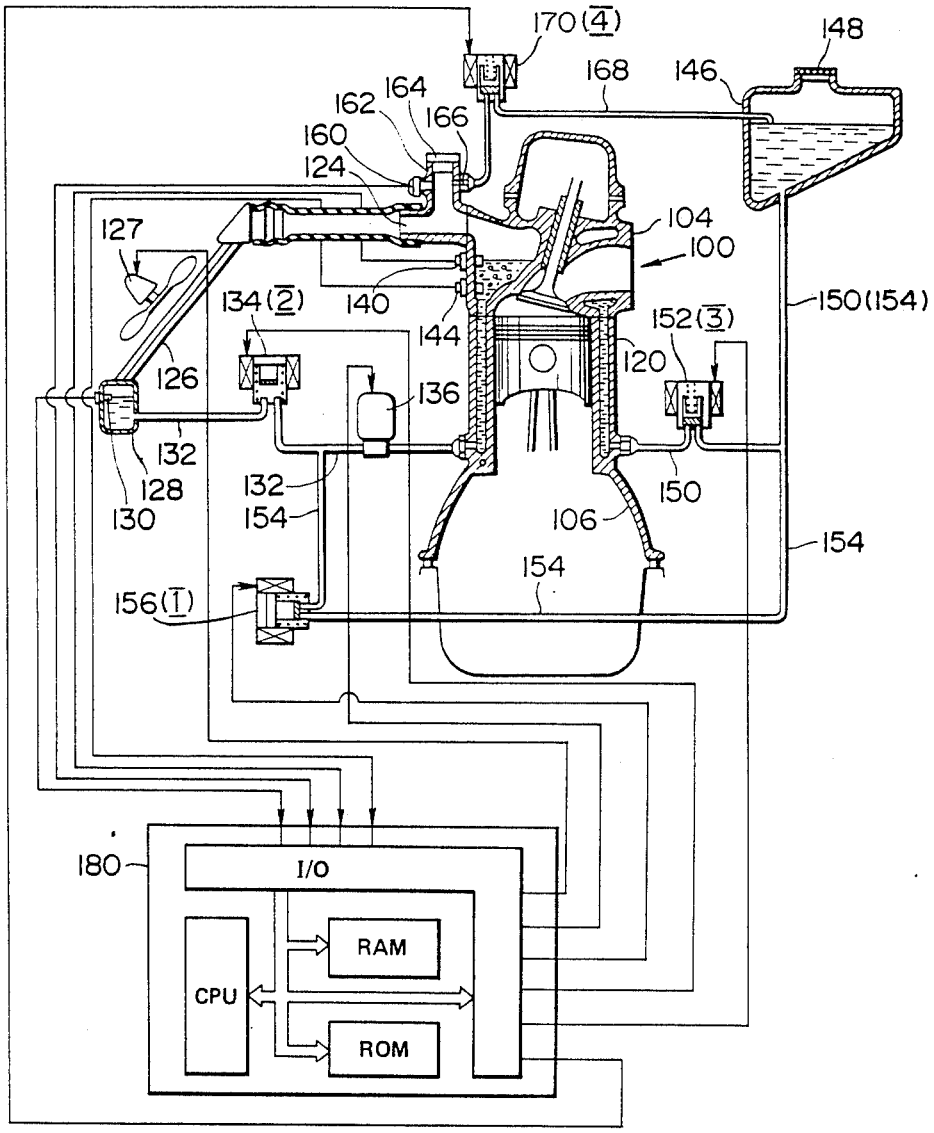
FIG.7 PRIOR ART
FIG. 7 shows in schematic elevation the arrangement disclosed in the opening paragraphs of the instant disclosure in conjunction with U.S. Pat. No. 4,549,505.

FIG. 5 graphically shows in terms of engine torque and engine speed the various load "zones" which are encountered by an automotive vehicle engine. In this graph, the curve F denotes full throttle torque characteristics, trace R/L denotes the resistance encountered when a vehicle is running on a level surface, and zones A, B and C denote respectively low load/low engine speed operation such as encountered during what shall be referred to as "urban cruising"; low speed high/load engine operation such as hillclimbing, towing, etc., and high engine speed operation such as encountered during high speed cruising.

A suitable coolant temperature for zone A is approximately 100°-110° C.; for zone B 80°-90° C. and for zone C 90°-100° C. The high temperature during "urban cruising" promotes improved thermal efficiency. On the other hand, the lower temperatures of zones B and C are such as to ensure that sufficient heat is removed from the engine and associated structure to prevent engine knocking and/or thermal damage.

With the present invention, in order to control the temperature of the engine, advantage is taken of the fact that with a cooling system wherein the coolant is boiled and the vapor used as a heat transfer medium, the amount of coolant actually circulated between the coolant jacket and the radiator is very small, the amount of heat removed from the engine per unit volume of coolant is very high, and upon boiling, the pressure prevailing within the coolant jacket and consequently the boiling point of the coolant rises if the system employed is of the closed circuit type. Thus, during "urban cruising" by circulating only a limited amount of cooling air over the radiator, it is possible reduce the rate of condensation therein and cause the pressure within the cooling system to rise above atmospheric and thus induce the situation, wherein the engine coolant boils at temperatures above 100° C. for example at approximately 110° C.

In addition to the control afforded by the air circulation, the present invention is arranged to positively pump coolant into and out of the system to vary the amount of coolant actually in the cooling circuit in a manner which modifies the pressure prevailing therein. The combination of the two controls enables the temperature at which the coolant boils to be quickly brought to and held close to that deemed most appropriate for the instant set of operation conditions.

On the other hand, during high speed cruising for example, when a lower coolant boiling point is highly beneficial, it is further possible by increasing the flow cooling air passing over the radiator, to increase the rate of condensation within the radiator to a level which reduces the pressure prevailing in the cooling system below atmospheric and thus induce the situation wherein the coolant boils at temperatures on the order of 80° to 100° C. In addition to this, the present invention also provides for coolant to be displaced out of the cooling circiut in a manner which lowers the pressure in the system and supplements the control provided by the fan in a manner which permits the temperature at which the coolant boils to be quickly brought to and held at a level most appropriate for the new set of operating conditions.

However, if the pressure in the system drops to an excessively low level, the tendency for air to find its way into the interior of the cooling circuit becomes excessively high and it is desirable under these circumstances to limit the degree to which a negative pressure is permitted to develop. The present invention controls this by introducing coolant into the cooling circuit while it remains in an essentially hermetically sealed state and raises the pressure in the system to a suitable level.

Each of the zones of control will be discussed in detail. It should be noted that the figures quoted in this discussion relate to a reciprocating type internal engine having a 1800 cc displacement.

ZONE A

In this zone (low speed/low torque), since the torque requirements are not high, emphasis is placed on good fuel economy. Accordingly, the lower limit of the temperature range of 100° to 110° C. is selected on the basis that, above 100° C. the fuel consumption curves of the engine tend to flatten out and become essentially constant. On the other hand, the upper limit of this range is selected in view of the fact that if the temperature of the coolant rises to above 110° C., as the vehicle is inevitably not moving at any particular speed during this mode of operation there is very little natural air circulation within the engine compartment and the temperature of the engine room tends to become sufficiently high so as to have an adverse effect on various temperature sensitive elements such as cog belts of the valve timing gear train, elastomeric fuel hoses and the like. Accordingly, as no particular improvement in fuel consumption characteristics are obtained by controlling the coolant temperature to levels in excess of 110° C., the upper limit of zone A is held thereat.

It has been found that the torque generation characteristics tend to drop off slightly with temperatures above 100° C. Accordingly, in order to minimize the loss of torque it is deemed advantageous to set the upper torque limit of zone A in the range of 7 to 10 kgm.

The upper engine speed of this zone is determined in view of that fact that above engine speeds of 2400 to 3600 RPM a slight increase in fuel consumption characteristics can be detected. Hence, as it is fuel economy rather than maximum torque production characteristics which are sought in this zone, the boundary between the low and high engine speed ranges is drawn within the just mentioned engine speed range. It will be of course appreciated as there are a variety of different types of engines on the market—viz., diesel engines (e.g., trucks, industrial vehicles), high performance engines (e.g., sports cars), low stressed engines for economical urban use vehicles, etc. The above mentioned ranges cannot be specified with any particular type in mind but do hold generally true for all types.

ZONE B

In this zone (high torque/low engine speed), torque is of importance. In order to avoid engine knocking, improve engine charging efficiency, reduce residual gas in the engine combustion chambers and maximize torque generation, the temperature range for this zone is selected to span from 80° to 90° C. With this a notable improvement in torque characteristics is possible. Further, by selecting the upper engine speed for this zone to fall in the range of 2,400 to 3,600 RPM it is possible to improve torque generation as compared with the case wherein the coolant temperature is held at 100° C., while simultaneously improving the fuel consumption characteristics.

The lower temperature of this zone is selected in view of the fact that if anti-freeze is mixed with the coolant, at a temperature of 80° C. the pressure prevailing in the interior of the cooling system lowers to approximately 630 mmHg. At this pressure the tendency for atmospheric air to leak in past the gaskets and seals of the engine becomes particularly high. Hence, in order to avoid the need for expensive parts in order to maintain the relatively high negative pressure (viz., prevent crushing of the radiator and interconnecting conduiting) and simultaneously prevent the invasion of air, the above mentioned lower limit is selected.

ZONE C

In this zone (high speed), as the respiration characteristics of the engine inherently improve, it is not necessary to maintain the coolant temperature as low as in zone B for this purpose. However, as the amount of heat generated per unit time is higher than during the lower speed modes the coolant tends to boil much more vigorously. As a result an increased amount of liquid coolant tends to bump and froth up out of the coolant jacket and find its way into the radiator.

Until the volume of liquid coolant which enters the radiator reaches approximately 3 liters/min. there is little or no adverse effect on the amount of heat which can released from the radiator. However, in excess of this figure, a marked loss of heat exchange efficiency may be observed. Experiments have shown that by controlling the boiling point of the coolant in the region of 90° C. under high speed cruising the amount of liquid coolant can be kept below the critical level and thus the system undergoes no particular adverse loss of heat release characteristics at a time when the maximization of same is vital to prevent engine overheating.

It has been further observed that if the coolant temperature is permitted to rise above 100° C. then the temperature of the engine lubricant tends to rise above 130° C. and undergo unnecessarily rapid degradation. This tendency is particular notable if the ambient temperature is above 35° C. As will be appreciated if the engine oil begins to degrade under high temperature, heat sensitive bearing metals and the like of the engine also undergo damage.

Hence, from the point of engine protection, the coolant is controlled within the range of 90°-100° C. once the engine speed has exceeded the value which divides the high and low engine speed ranges.

EMBODIMENT

Figure 8:
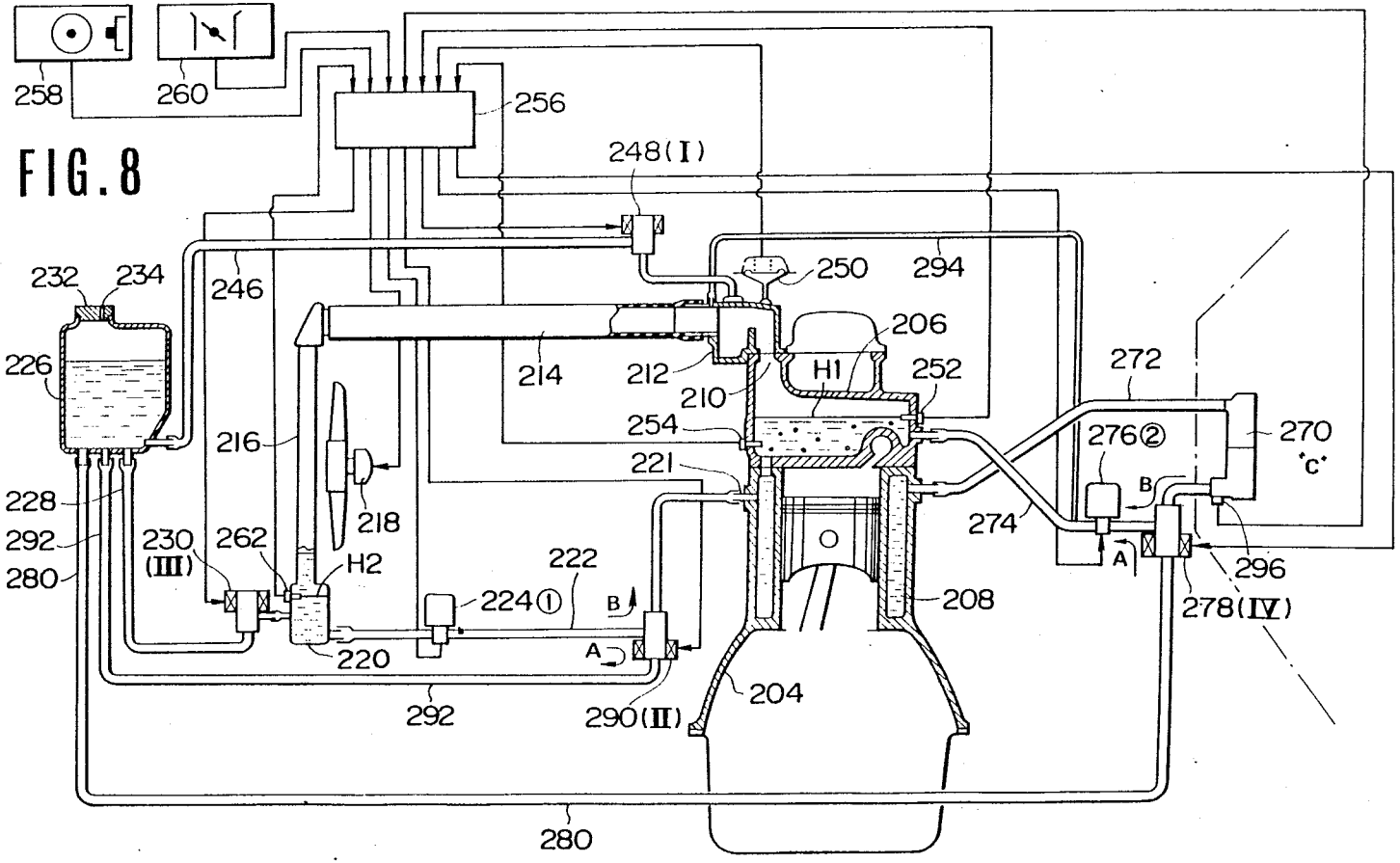
FIG. 8 shows an engine system which includes a first embodiment of the present invention, respectively.

FIG. 8 of the drawings shows an engine system to which an embodiment of the invention is applied. In this arrangement an internal combustion engine 200 includes a cylinder block 204 on which a cylinder head 206 is detachably secured. The cylinder head and block are formed with suitable cavities which define a coolant jacket 208 about a structure of the engine subject to high heat flux (e.g., combustion chambers, exhaust valves, conduits, etc.,). Fluidly communicating with a vapor discharge port 210 formed in the cylinder head 206 via a vapor manifold 212 and vapor conduit 214, is a condensor 216 or radiator as it will be referred to hereinafter. Located adjacent the radiator 216 is a selectively energizable, electrically driven fan 218 which is arranged to induce a cooling draft of air to pass over the heat exchanging surface of the radiator 216 upon being put into operation. This fan is arranged to be energizable at different levels.

A small collection reservoir 220 or lower tank as it will be referred to hereinafter, is provided at the bottom of the radiator 216 and arranged to collect the condensate produced therein. Leading from the lower tank 220 to a coolant inlet port 221 formed in the cylinder head 206 is a coolant return conduit 222. A small capacity electrically driven pump 224 is disposed in this conduit at a location relatively close to the radiator 216.

A coolant reservoir 226 is arranged to communicate with the lower tank 220 via a supply/discharge conduit 228 in which an electromagnetic flow control valve 230 is disposed. This valve is arranged to close when energized. The reservoir 226 is closed by a cap 232 in which an air bleed 234 is formed. This permits the interior of the reservoir 226 to be maintained constantly at atmospheric pressure.

The vapor manifold 212 in this embodiment is formed with a purge port (no numeral) which communicates with the reservoir 226 via an overflow conduit 246.

A normally closed ON/OFF type electromagnetic valve 248 is disposed in conduit 246 and arranged to be open only when energized. Also communicating with the vapor manifold 214 is a pressure differential responsive diaphragm operated switch arrangement 250 which is triggered to change from one state (e.g., open) to another (e.g., closed) upon the pressure prevailing within the cooling circuit (viz., the coolant jacket 208, vapor manifold 214, vapor conduit 214, radiator 216 and return conduit 222) dropping below atmospheric pressure by a predetermined amount. In this embodiment the pressure sensor 250 (as it will be referred to hereinafter for simplicity) is arranged to switch upon the pressure in the cooling circuit reaching a threshold level on the order of −30 to −50 mmHg.

In order to control the level of coolant in the coolant jacket, a level sensor 252 is disposed as shown. It will be noted that this sensor 252 is located at a level (H1) which is higher than that of the combustion chambers, exhaust ports and valves (structures subject to high heat flux) so as to maintain same securely immersed in liquid coolant and therefore attenuate engine knocking and the like due to the formation of localized "dry outs" and subsequent zones of abnormally high temperature (viz., "hot spots").

Located below the level sensor 252 so as to be immersed in the liquid coolant is a temperature sensor 254. The output of the level sensor 252 and the temperature sensor 254 are fed to a control circuit 256 or modulator which is suitably connected with a source of EMF (not shown). It will be noted that it is possible to use a pressure sensor in lieu of a temperature sensor. However, pressure sensors tend to be expensive and to be overly responsive to momentary pressure fluctuations which occur in the coolant jacket. By immersing the temperature sensor in the liquid coolant it is possible to obtain a stable and reliable temperature reading.

The control circuit 256 further receives an input from the engine distributor 258 (or like device) which outputs a signal indicative of engine speed and an input from a load sensing device 260 such as a throttle valve position sensor. It will be noted that as an alternative to throttle position, the output of an air flow meter, an induction vacuum sensor or the pulse width of fuel injection control signal may be used to indicate load. In case the engine is fuel injected, it is also possible to use the frequency of the fuel injection signal as an indication of engine speed as well as using the pulse width to indicate load.

A second level sensor 262 is disposed in the lower tank 220 at a level H2. This level sensor is used to control the level at which fan 218 is energized. Additional functions of this sensor will become clear hereinafter when a discussion of the operation of the embodiment of the invention is made in conjunction with the flow charts of FIGS. 9–22 hereinafter. From the view point of safety it is advantageous to arrange level sensors 252 and 262 to assume an ON state when the levels are above H1 and H2, respectively. With this arrangement, should either fail, a tendency for the system to be overfilled with liquid coolant rather than the reverse is induced by the resulting continuous OFF indication.

Leading from a section of the coolant jacket 208 formed in the cylinder block 204 to a heater core 270 disposed in the passenger compartment of the vehicle (no numeral) in which the engine 200 is mounted, is a heater supply conduit 272. Leading from the heater core 270 to a section of the coolant jacket 208 formed in the cylinder head 206 is a heater return conduit 274. A coolant circulation pump 276 is disposed in this conduit and arranged to induce coolant to flow through the heating conduit (supply conduit 272, core 270 and return conduit 272) when energized. A three-way valve 278 is disposed in the return conduit 274 at a location intermediate of the pump 276 and heater core 270 (viz., of upstream the pump 276). Leading from the three-way valve 278 to the reservoir 226 is a coolant induction conduit 280. The three-way valve 278 is arranged to have a first position wherein fluid communication between the heater core 270 and the circulation pump 276 is established (flow path B) and a closed position wherein this communication is interrupted and communication between the reservoir 226 and the circulation pump 276 is established (flow path A). In this second position or state, upon energization of the circulation pump 276 coolant is induced from the reservoir 226 and pumped into the coolant jacket 208.

It will be noted that in this embodiment the heating circuit is arranged so that the supply conduit 272 communicates with a section of the coolant jacket 208 formed in the cylinder block 204 and the return conduit 274 communicates with a section of the coolant jacket 208 formed in the cylinder head 206. With this arrangement, when the heating circuit is used to heat the vehicle cabin C, the coolant which is returned to the coolant jacket 208 is relatively cool having released a substantial amount of its heat to the cabin, and thus tends to quell the violence of the bumping and frothing that accompanies active boiling of the coolant in and around the cylinder head and associated structure subject to high heat flux. When the three-way valve 278 is set to permit coolant from the reservoir 226 to be introduced into the coolant jacket 208, the relatively low temperature of this liquid has an even more powerful passifying effect and tends to eliminate any cavitation therein.

The valve and conduit means of this embodiment which interconnect the cooling circuit and the heating circuit includes a further three-way valve 290. This valve 290 as shown, is disposed in the coolant return conduit 222 at a location between the coolant return pump 224 and the coolant jacket 208. This valve 290 is arranged to have a first state or position wherein fluid communication between the return pump 224 and the reservoir 226 is established via a discharge conduit 292 (viz., establish flow path A), and a second position or state wherein this communication is interrupted and "normal" communication between the coolant return pump 224 and the coolant jacket 208 is established (establish flow path B).

This embodiment further features what shall be referred to as a "blending conduit" 294 which leads from immediately downstream of the coolant circulation pump 276 to the vapor manifold 212. With this arrangement, when the heater circulation pump 276 is energized, a fraction of its output is transferred via the blending conduit 294 to the vapor maifold 212 and subsequently carried along the vapor transfer conduit 214 with the coolant vapor to the radiator 216.

The volume of coolant which can be transferred through the blending conduit 294 is limited (via the provision of orifices or the like in conduits 274 and 294 if required) to an amount which promotes the unification of anti-freeze distribution throughout the cooling circuit but which does not overly wet the interior of the radiator 216.

The reason for this provision is that the concentration of the anti-freeze in the coolant jacket 208 tends to rise as the "distillation" like "boiling—vapor—condensation" cycle proceeds leaving the condensate at the bottom of the radiator 216 and lower tank 220 with a low concentration. This unbalanced distribution of the anti-freeze invites freezing of the coolant in the radiator 216 and associated conduiting which are the most susceptible elements of the system to the cold.

To facilitate appropriate control of the heater circulation pump 276, a temperature sensor 296 is disposed in the discharge port of the heater core 270. With this provision, when the coolant temperature is low, pump 276 is operated at a high power level to ensure that the amount of heat emitted from the heater core 270 is maximized. By lowering the power level with an increasing temperature, fluctuations in cabin heating due to interruption of the coolant flow through the core 270 by the establishment of flow path A by valve 278 and due to the variation in coolant temperature per se is reduced.

It is worth noting that the vapor manifold 212' in this embodiment is constructed in a manner to have a baffle (no numeral) which extends upwardly in a manner to limit the amount of liquid coolant which can "bump" and "froth" over into the vapor transfer conduit 214.

OPERATION OVERVIEW

Prior to use, the cooling circuit is filled to the brim with coolant (for example water or a mixture of water and antifreeze or the like) and the cap 242 securely set in place to seal the system. A suitable quantity of additional coolant is also introduced into the reservoir 226. At this time the electromagnetic valve 230 should be temporarily energized so as to assume a closed condition. Alternatively, and/or in combination with the above, it is possible to introduce coolant into the reservoir 226 and manually energize valve 278 in a manner to establish flow path A while simimiltaneously energizing pump 224 so as induct coolant from the reservoir 226 via conduit 280 and pump same into the lower tank 220 until coolant can be visibly seen spilling out of the open riser 240. By securing the cap 242 in position at this time the system may be sealed in a completely filled state.

To facilate this filling and subsequent servicing of the system a manually operable switch may be arranged to permit the above operation from "under the hood" without actually starting the engine.

When the engine is started, as the coolant jacket 208 is completely filled with stagnant coolant, the heat produced by the combustion in the combustion chambers cannot be readily released via the radiator 216 to the ambient atmosphere and the coolant rapidly warms and begins to produce coolant vapor. At this time valve 230 is left de-energized (open) whereby the pressure of the coolant vapor begins displacing liquid coolant out of the cooling circuit (viz., the coolant jacket 208, vapor manifold 212, vapor conduit 214, radiator 216, lower tank 220 and return conduit 222).

During this "coolant displacement mode" it is possible for either of two situations to occur. That is to say, it is possible for the level of coolant in the coolant jacket 208 to be reduced to level H1 before the level in the radiator 216 reaches level H2 or vice versa, viz., wherein the radiator 216 is emptied to level H2 before much of the coolant in the coolant jacket 208 is displaced. In the event that latter occurs (viz., the coolant level in the radiator falls to H2 before that in the coolant jacket reaches H1), valve 230 is temporarily closed and an amount of the excess coolant in the coolant jacket 208 allowed to "distill" over to the radiator 216 before valve 230 is reopened. Alternatively, if the level H1 is reached first, level sensor 252 induces the energization of pump 224 and coolant is pumped from the lower tank 220 to the coolant jacket 208 while simultaneously being displaced out through conduit 228 to reservoir 226.

The load and other operational parameters of the engine (viz., the outputs of the sensors 258 and 260) are sampled and a decision made as to the temperature (TARGET temperature) at which the coolant should be controlled to boil. If the desired temperature is reached before the amount of the coolant in the cooling circuit is reduced to its minimum permissible level (viz., when the coolant in the coolant jacket 208 and the radiator 216 are at levels H1 and H2 respectively) it is possible to energize valve 230 so that it assumes a closed state and places the cooling circuit in a hermetically closed condition. It should be noted however, that upon the coolant in the circuit being reduced to the minimum level (viz., when the levels in the coolant jacket 208 and the lower tank 220 assume levels H1 and H2 respectively) the displacement of coolant from the circuit is terminated in order to prevent a possible shortage of coolant in the coolant jacket 208.

If the temperature at which the coolant boils should exceed the value determined to be the optimum for the instant set of engine operational conditions, fan 218 can be energizable. According to the present invention the fan is energizable at different levels. In this embodiment at a high level and at a lower one. In the event that the level of coolant in the lower tank 220 is above level H2 the lower level is normally selected to avoid wasting power and producing unncessary fan noise.

If the fan operation fails to bring the boiling point under control it is possible to, in the event that the level of liquid coolant in the radiator 216 is still above H2 and the pressure in the cooling circuit is not sub-atmospheric, to briefly open valve 230 and permit an amount of coolant to be displaced under the influence of the pressure in the cooling circuit out to the reservoir 226. This reduces the volume of liquid coolant in the cooling circuit and tends to increase the surface area available in the radiator 216 for coolant vapor to release its latent heat of evaporation. Alternatively, it is possible to set valve 290 to flow path A and energize return pump 224 to positively remove coolant. However, if this pump is "cavitating" (viz., the coolant is volatilizing in the pump chambers to the point of preventing any appreciable amount of pump output) this measure usually does not prove effective and the above mentioned procedure is reverted to.

On the other hand, should the ambient conditions or the like (e.g. very cold weather, prolonged downhill coasting etc.) induce the situation wherein the rate of condensation in the radiator 216 becomes excessive and reduces the pressure and thus the boiling point of the coolant below that required, if termination of fan operation is insufficient to adjust the rate of condensation to an appropriate level, it is possible to briefly open valve 230 and permit the inherent sub-atmospheric pressure to induct an amount of coolant from the reservoir 226 in a manner which increases the amount of liquid coolant in the lower tank 220, increases the pressure in the system toward atmospheric and reduces the dry surface area of the radiator 216 which is available for latent heat release.

During engine operation, in the event that coolant return pump 224 is sensed as being operated for excessively long periods of time, for example in excess of 10 seconds, it possible that the coolant and system has become heated to the point that the pump is "cavitating" and the vital liquid coolant level (H1) in the coolant jacket 208 is not being properly maintained. Under such circumstances it is possible according to the present invention to condition three-way valve 278 to establish flow path B and energize coolant circulation pump 276 in a manner to pump fresh coolant into the coolant jacket 208 until such time as level sensor 252 indicates that the level of coolant has been adequately replenished. The introduction of relatively low temperature coolant in this manner strongly suppresses any tendency for "cavitation" (viz., the persistant formation of localized vapor pockets) to occur in the coolant jacket. However, since this mode of operation increases the amount of coolant in the cooling circuit, the pressure and thus the boiling point of the coolant tends to rise. This phenomenon is utilized by awaiting the generation of a slightly superatmospheric pressure in the cooling circuit and then briefly opening valve 230. This permits discharge of the coolant back out to the reservoir 226 under the influence of the pressure differential therebetween.

As mentioned above it is possible to energize the cooling fan with different levels of power. Thus, it is possible to continously energize fan 218 at a suitable power level so as to induce a rate of cooling which induces a negative pressure in the cooling circuit. At this time a brief opening of valve 230 will permit cool coolant from the reservoir to be inducted into the lower tank 220. This, as previously disclosed, reduces the negative pressure and the dry surface area of the radiator. It also lowers the temperature of the coolant in the lower tank 220 in a manner which will alleviate the tendancy for the coolant return pump 224 to undergo cavitation. A subsequent discharge of coolant under the influence of a slightly super-atmospheric pressure permits the amount of coolant in the cooling circuit be re-adjusted.

The above described pump in-discharge-induct-discharge type cycle permits the amount of heat contained in the cooling circuit to be reduced and in part transferred to the coolant in the reservoir 226.

If the need to use pump 276 in lieu of coolant return pump 224 persists for some time it is possible to issue a warning signal that a system malfunction other than cavitation has more than likely occurred and that coolant return pump 224 is more than likely malfunctioning due to mechanical failure or the like.

When the engine is stopped it is advantageous to maintain the system in a closed circuit state until such time as the boiling of the coolant due to the heat accumulated in the engine and associated apparatus subsides so that loss of coolant due to violent displacement of coolant out of the cooling system to the reservoir 226 under the influence of super-atmospheric presures does not occur. This "cool down" control can be achieved by arbitariy setting the "Target" temperature to which the coolant should be controlled to a relatively low level such as 85° C.

When the system has cooled sufficiently it can be totally de-energized and permitted to assume an open circuit state. Under these conditions, as the coolant vapor in the cooling circuit condenses, coolant is forced from the reservoir 226 into the lower tank 220 via conduit 228 under the influence of the pressure differential which naturally develops therebetween until such time as the cooling circuit is completely filled or the pressure differential between the ambient atmosphere and the interior of the system becomes zero. In this state the tendency for air to leak into the system is essentially non-existent.

When the engine is restarted, in order to ensure that the system remains essentially free of contaminating air which will, if permitted to enter the radiator 216, cause a marked decrease in heat exchange efficiency, the temperature of the engine coolant is checked. In the event that the engine coolant is cold, for example below 45° C., then a so called non-condensible matter purge is performed wherein three-way valve 278 is conditioned to produce flow path A, valve 248 conditioned to assume an open condition, valve 230 closed, valve 290 conditioned to establish flow path B and circulation pump 276 energized. Under these conditions coolant is inducted from the reservoir 226 and pumped into the cooling circuit. As the circuit should be essentially full of liquid coolant at this temperature, as coolant is forced into the cooling circuit the excess overflows back to the reservoir 226 via overflow conduit 246 carrying with it any air or the like which has possibly accumulated in the system. The energization of the pump 276 can be maintained for several seconds to several tens of seconds depending on the circumstances. Under normal circumstances 10 seconds has been found sufficient to ensure that the system remains free of air or the like.

However, if when the engine is restarted the temperature of the coolant is found to be 45° C. or more (viz., the engine is still warm) it is deemed that insufficient time has lapsed since the last engine operation for any substantial amount of air or the like non-condensible matter to have leaked into the system and the purge operation is by-passed. This also speeds up the engine warm-up process by avoiding unnecesary introduction of relatively cool coolant into coolant jacket 208.

It should be noted that it is within the scope of the present invention to vary the time for which the purge operation is carried out in response to such factors as ambient temperature and the like. For example, in very cold climates the radiator 216 will tend to be partially filled with liquid coolant and the presence of some contaminating air is not notably detremental. In the event of an excessively high temperature occurring, it is possible to perform a "hot purge" wherein valve 230 can be momentarily opened to permit coolant vapor to rush down through the radiator and vent out to the reservoir 226 via conduit 228. This tends to flush out any air trapped in the radiator 216. As the vapor bubbles through the coolant in the reservoir 226 a kind of "steam trap" occurs which condenses the vapor and prevents any notable loss of coolant to the ambient atmosphere.

As a safety measure it is possible to arrange for valve 248 to have a construction which, even if not energized, permits excess pressure to be automatically vented therethrough in the event that all other measures fail. This failsafe feature can be achieved by setting the spring which biases the valve element to a closed position to hold the element closed until a maximum permissible pressure prevails in the system.

The specific operations of this embodiment will become more clearly appreciated as a description of the flow charts which depict the characterstics of the system control is given hereinafter. It should be noted that throughout the flow charts a convention wherein: valve 248 is referred to as valve I; valve 290—valve II; valve 230—valve III; coolant return pump 224—pump 1; and coolant circulation pump 276—pump 2 has been used for brevity. C/J and L/T denote coolant jacket and lower tank, respectively.

SYSTEM CONTROL ROUTINE

Figure 9A:
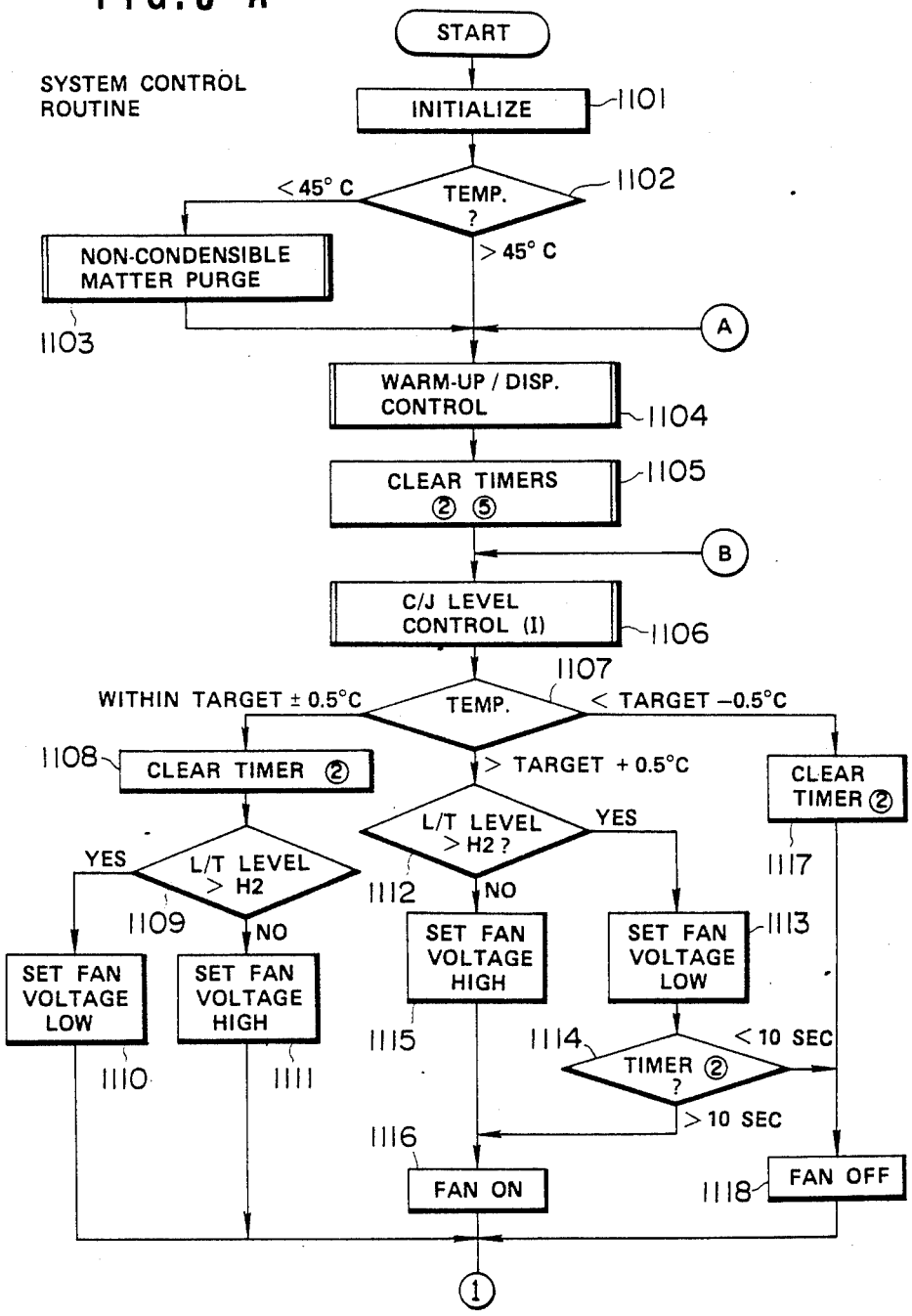
Figure 9B:
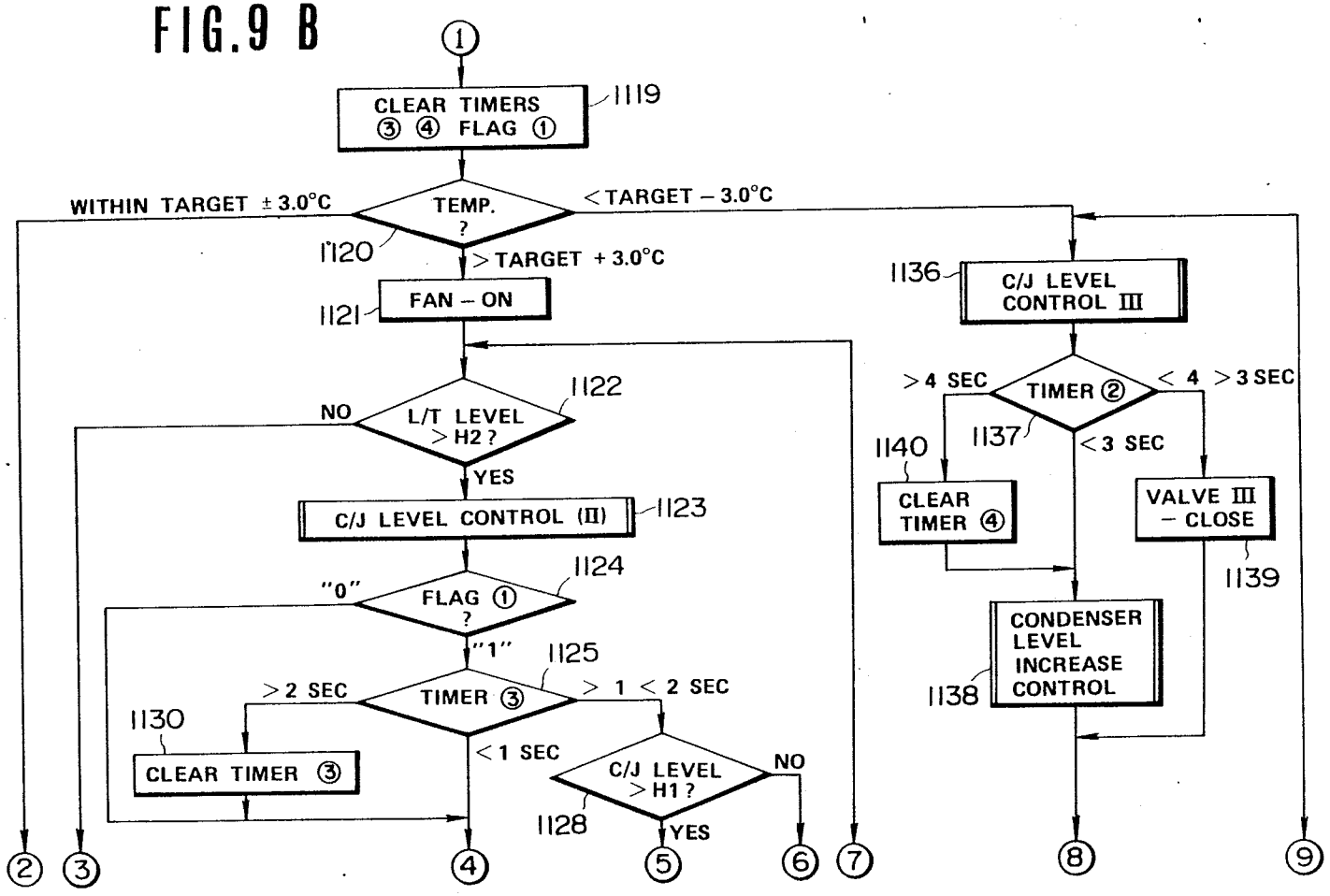
Figure 9C:
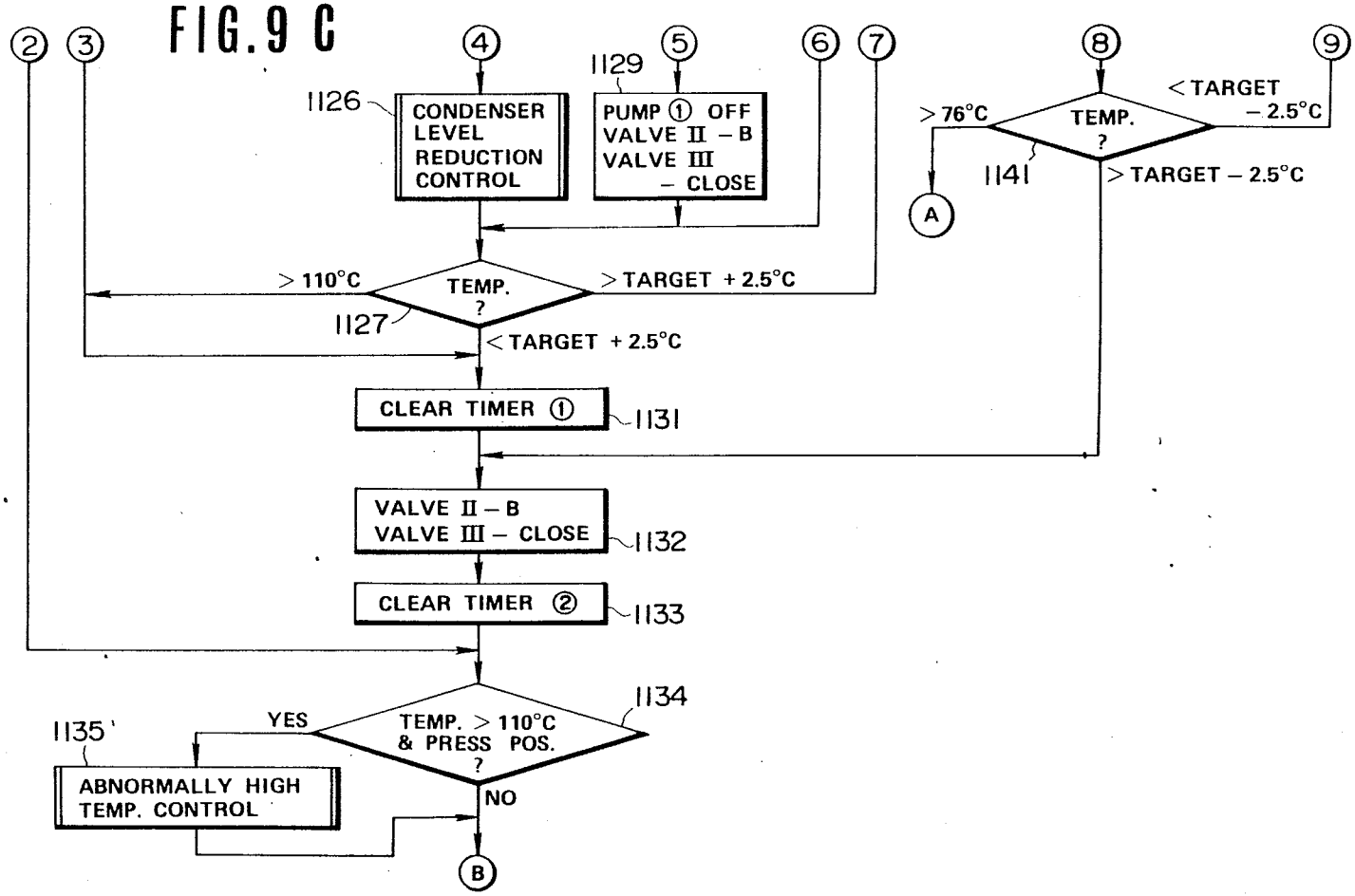

FIGS. 9A to 9C show the steps which characterize the overall control of the system of the third emodiment.

At step 1101 the system is initialized. This process takes place in response to a demand for engine operation such as an operator switching on the ignition system and/or attempting to crank the engine. This process includes clearing of any residual data from RAM, setting peripheral interface adapter or adapters and the conditioning the system to permit interrupts. At step 1102 the output of the temperature sensor 254 is read and a determination made as to whether the engine is cold or not. In this embodiment if the engine coolant (liquid) coolant is sensed as being below a predetermined value (45° C.) then the engine is deemed to be cold while if above this value the engine is considered to be "warm".

In the event that outcome of the enquiry performed at step 1102 indicates that the engine is "cold" then the control flows to step 1103 wherein a sub-routine which executes a non-condensible matter purge is implemented. However, if the engine is found to be "warm" then step 1103 is by-passed and the program flows directly to step 1104 wherein a warm-up/displacement control sub-routine is run. For simplicity this sub-routine will be referred to as a warm-up routine hereinafter.

Figure 14:
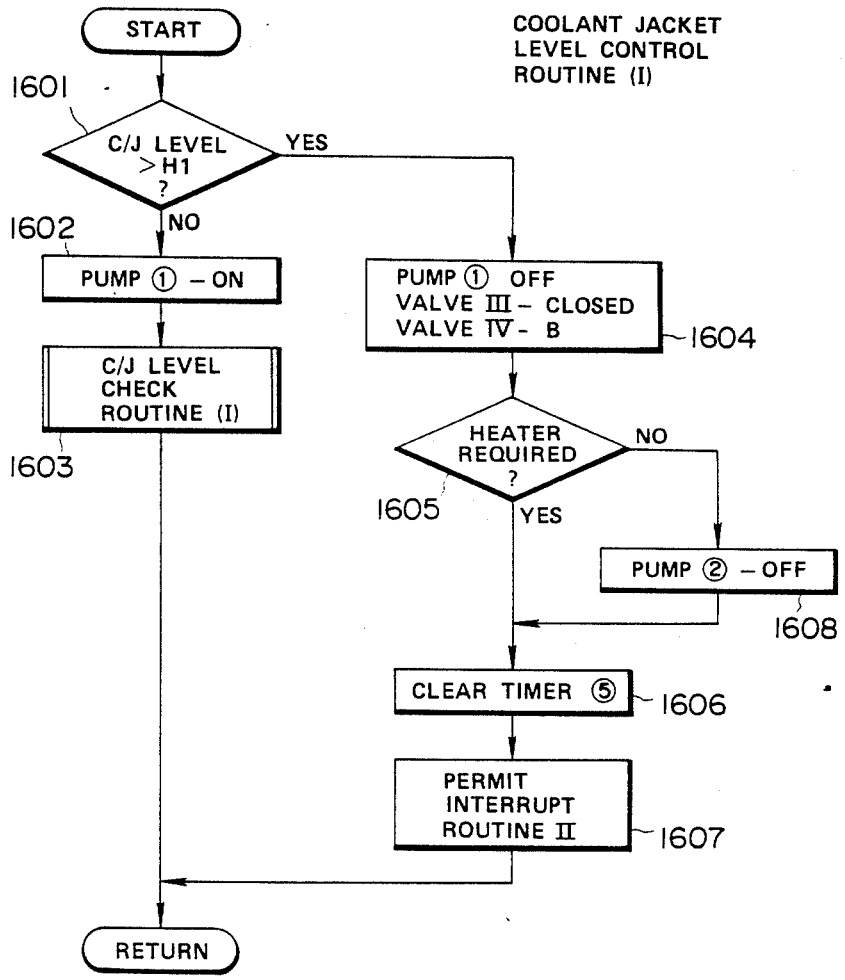
Figure 15:
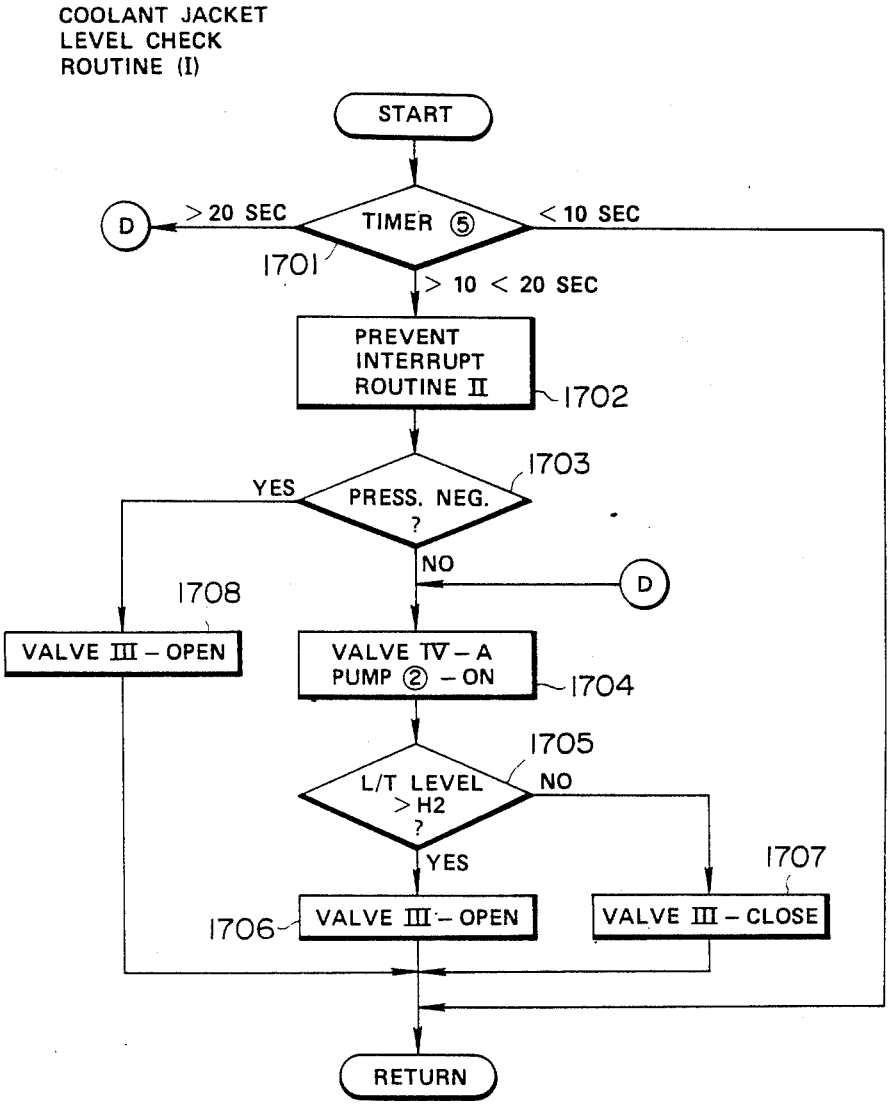

At step 1105 soft clocks or timers 2 and 5 (as they will be referred to) are cleared and reset counting and at step 1106 a first coolant jacket level control sub-routine run. As will be appreciated hereinlater when a discussion of FIGS. 14 and 15 is made, this sub-routine monitors the time (using timer 5) for which the coolant return pump 224 is operated and which implements measures to overcome pump cavitation in the event the said pump is operated for more than a predetermined period (in this embodiment 10 seconds).

At step 1107 the output of the coolant temperature sensor 254 is again sampled and the temperature ranged as shown. In the event the temperature is found to be in an acceptably small range of the desired or TARGET temperature, the program flows to step 1108 wherein timer 2 is again cleared and then proceeds to sample the output of the level sensor 262 disposed in lower tank 220. In the event that the lower tank 220 is filled to a level higher than level sensor 262, then at step 1110 a command lowers the voltage of the electrical power with which the cooling fan 218 is to be energized with at a predetermined low level. This prevents fruitless waste of electrical power and reduces fan noise. However, in the event that the level of coolant is lower than sensor 262, the fan energization voltage level is set at a predetermined high level. Viz, if the level of coolant in the lower tank 220 falls below a minimum desirable level then it is possible that the coolant which is inducted by the coolant return pump 224 will contain sufficient heat as to undergo rapid vaporization in the chambers of the pump and induce the highly undesirably "cavitation" phenomenon. To obviate this possibility by setting the fan 218 to operate at a high level of energization, a larger amount of heat can be removed from the radiator 216 upon the fan 218 being put into use and thus induce the situation wherein the condensate which collects in the lower tank 220 contains a reduced amount of heat. Further, under these conditions due to large "dry" surface area of the radiator the fan will be highly effective and not waste power.

If the temperature of the coolant is found to be above TARGET by more than the allowable small amount, then the program flows to step 1112 wherein the level of coolant in the lower tank 220 is again checked. If the outcome of the enquiry indicates that the level is above level H2 then the fan voltage is set at a low level (step 1113) and at step 1114 the count of timer 2 is checked. In the event that the count is less than 10 seconds the program flows to step 1116 wherein a command to energize the cooling fan is issued. However, if the count has exceeded the 10 second limit then the program goes to step 1118 wherein operation of the fan 218 is stopped.

In the case wherein the level check performed in step 1112 indicates that the level of coolant in the lower tank is lower than sensor 262 (viz., level H2) then at step 1115 the fan voltage is set at a high level and at step 1116 the fan 218 is accordingly energized. However, should the ranging of step 1107 indicate that the instant coolant temperature is below target by 0.5° C. then at step 1117 soft clock or timer 2 is cleared and at step 1118 the operation of the fan 218 is stopped.

At step 1119 (top of FIG. 9B) timers 3 and 4 are cleared and reset counting and a flag (FLAG 1) is set to zero. At step 1120 the coolant temperature is again ranged. If the temperature in the coolant jacket is within a predetermined range then the program flows directly to step 1134 wherein it is determined if the temperature of the coolant is above 110° C. and the pressure in the system positive. However, since in this instance both of these requirements are not usually met the program recycles to step 1106 (FIG. 9A).

If the temperature is found to be on the high side of TARGET then the program flows to step 1121 wherein a command to energize fan 218 is issued. The voltage with which the fan 218 is operated is determined in the preceding steps. At step 1122 the level of coolant in the lower tank 220 is checked. If the level is low then the program flows directly to step 1131. In the event that an adequate amount of coolant is determined to be contained in the lower tank 220 than at step 1123 a second coolant jacket level control sub-routine is run. This routine, as will become clear hereinafter, also contains a check routine which monitors the time for which the coolant return pump 224 is operated in order to detect a possible malfunction of the existence of cavitation.

At step 1124 the status of FLAG 1 (set in the above mentioned first interrupt routine) is checked. In the event that this flag is set at "0" then the program flows directly to step 1126 wherein a condensor level reduction control sub-routine is run. However, in the event that FLAG 1="1", then the program goes to step 1125 wherein the count of timer 3 is checked. If the count indicates a period of more than 2 seconds then at step 1130 timer 3 is cleared. When the count of timer 3 is between 1 and 2 seconds then at step 1128 the level of coolant in the coolant jacket is checked by sampling the output of level sensor 252. If sufficient coolant is determined to be contained in the coolant jacket then the system is conditioned as shown in step 1129. However, when the level of coolant has dropped below level H1, the program flows directly to step 1127 wherein the instant coolant temperature is ranged.

If the temperature is on the low side or, alternatively, higher than a maximum desirable limit of 110° C., then the program proceeds to step 1131 wherein timer 1 is cleared. However, if the temperature of the coolant is found to be less than 110° C. but higher than TARGET by 2.5° C. then the program recycles to step 1122.

At steps 1132 and 1133 the system is conditioned as shown and timer 2 is cleared. In the event that step 1134 indicates an engine overheat condition then at step 1135 an abnormally high temperature control sub-routine is run.

Following steps 1134 and 1135 the program recycles to step 1106 as previously mentioned.

INTERRUPT ROUTINE (I)

Figure 10:
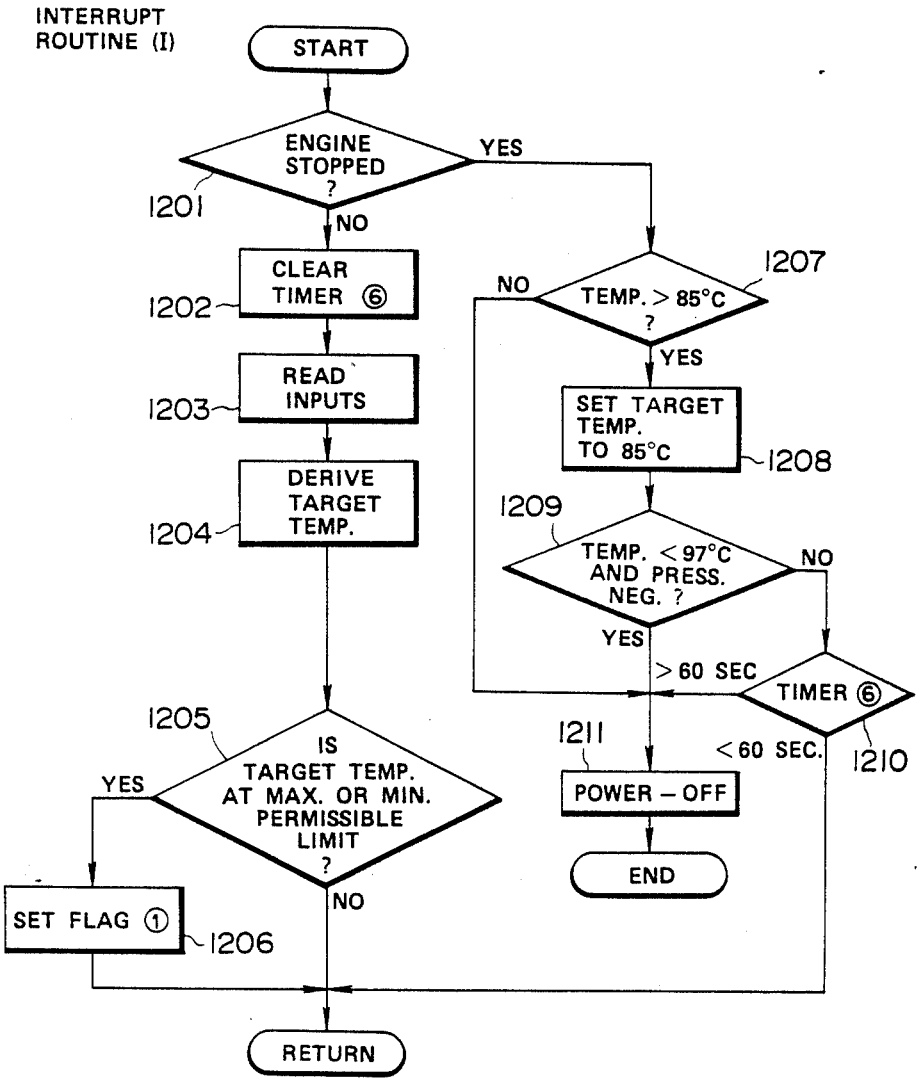

FIG. 10 shows a first of two interrupt routines which are run at predetermined intervals. The instant interrupt determines the current status of the engine, viz., determines if the engine is running or not. In the event that engine is running the most appropriate temperature for the coolant (TARGET temp) is determined. However, if the engine is stopped this routines executes a shut-down or cool-down control (steps 1207–1211).

In more detail, at step 1201 the instant status of the engine is determined. This may be done by sampling the output of engine speed sensor 258 for example. If the engine speed is zero or below a predetermined value, then the engine is deemed to be stopped and the program flows to steps 1207 to 1211.

As shown, the first step of this shut-down section is such as to set the TARGET temperature arbitarily at 85° C. At step 1209 it is determined if the temperature of the coolant is less than 97° C. and simultaneously if the pressure differential sensitive device (pressure sensor) 250 indicates that the pressure in the cooling circuit is sub-atmospheric. In the event that both of these requirements are met then it is deemed that it is safe to render the system open circuit and allow coolant to be inducted thereinto from the reservoir 226. However, if either one of these two requirements are not met then at step 1201 a timer 6 is set counting. Upon the count of this timer exceeding a period of 60 seconds (by way of example) the program is allowed to proceed to step 1211 wherein all of the power to the system is terminated even if the double requirements of step 1209 is not yet met; it being deemed that sufficient time has passed for the engine to have cooled to the point where vigorous boiling due to thermal inertia is no longer occuring and it is safe to go to an open circuit condition.

In the event that the engine is determined to be running in step 1201 then at step 1202 timer 6 is cleared and at step the various data inputs from the sensors of the system are read. In particular the outputs of sensors 258 and 260 are read and at step 1204 this data is used to determine the TARGET temperature. This value is then set in RAM in readiness to be read out during the various temperature ranging steps which are executed during control of the system.

As will be appreciated, the TARGET value can be determined either by table look-up or by algorithm. For example, a table which logs data in a manner such as shown in FIG. 5 of the drawings can be set in ROM and most appropriate temperature determined by using the engine speed and load magnitudes obtained by reading the inputs of sensors 258 and 260. Since the methods via which this value may be derived will be obvious to those skilled in the art of computer programming no further description is deemed necessary and will be omitted for brevity.

At step 1205 it is determined if the value of TARGET has reached either the upper or lower permissible temperature limits, for example 110° C. or 90° C. If the value of TARGET has been set at either of these values then as step 1205 FLAG 1 is set to "1".

It will be remembered that this routine is run at frequent intervals so that the value of TARGET in RAM is frequently updated.

INTERRUPT ROUTINE (II)

Figure 11:
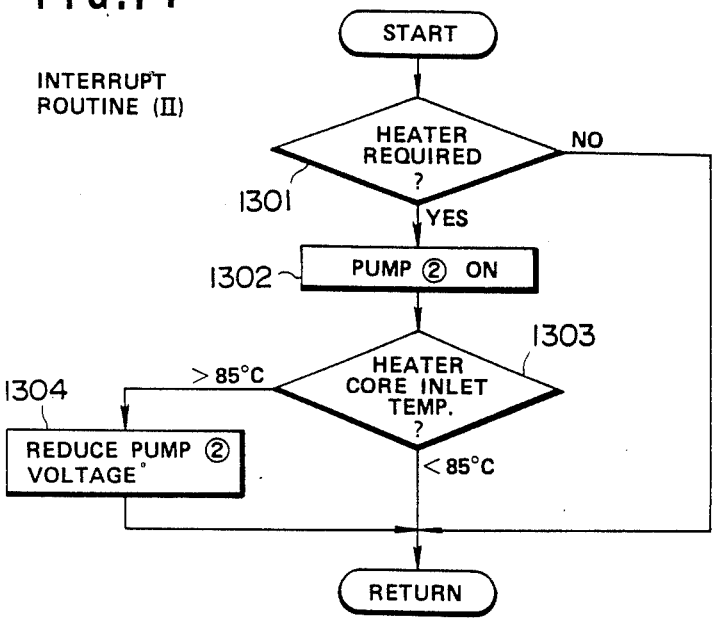

FIG. 11 shows the second of the two interrupt routines used in the present embodiment. The purpose of this routine is to regularly determine if the heating circuit is required and if so, at what voltage the circulation pump 224 should be energized. It will be noted that this interrupt is sometimes prevented. The reason for this is to avoid the possibility that control of other routines will not be suddenly reversed or otherwise interrupted. For example, during a level control routine wherein the circulation pump is energized to pump coolant into the coolant jacket, an untimely running of the second interrupt might stop the pump (or vice versa) in direct contradiction to the level control requirements.

In more detail, at step 1301 the position of a heat control switch (not shown) for example is sampled and the determination made as to the requirement for cabin heating. If such a requirement is absent then the program returns. On the other hand, if the switch or like device is found to be set to a position indicating that the cabin needs heating, then at step 1302 a command to energize circulation pump 276 at maximum power is issued and at step 1303 the output of temperature sensor 296 is sampled. In the event that the coolant entering the heat core is below 85° C. then the program returns. However, if above this level then the program flows to step 1304 to determine the power level at which the pump should be energized. For example, the voltage of the signal applied to the pump can be reduced from a maximum value at 85° C. to a minimum value at 95° C. As the temperature of the coolant rises, the amount of heat contained therein increases and the volume of liquid that need be circulated to produce the same cabin heating effect decreases. Following a brief setting of valve 278 to flow path A the temperature of the coolant in the core will decrease. Hence, following the re-establishment of flow path B it may be necessary to increase the flow rate for a time to compensate for the brief reduction in heating.

NON-CONDENSIBLE MATTER PURGE ROUTINE

Figure 12:
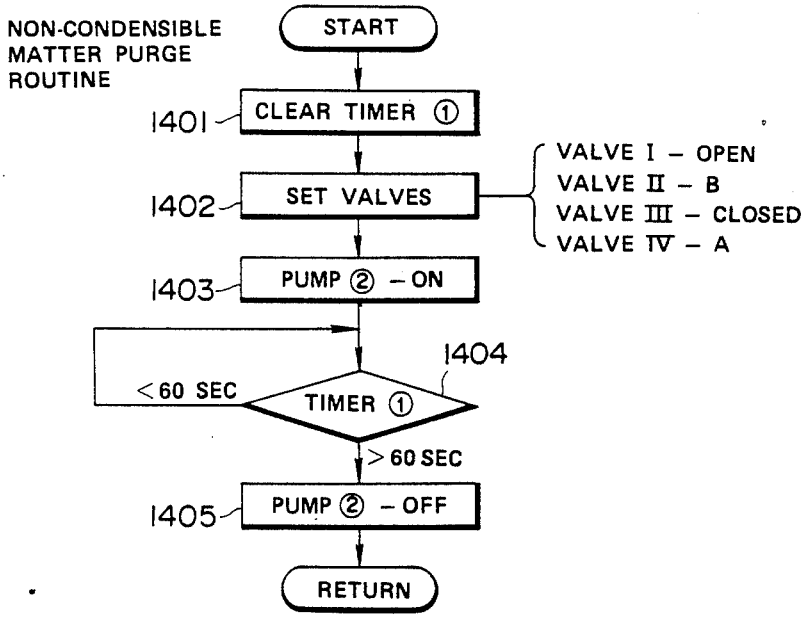

FIG. 12 shows the steps which characterize the system control which overfills the coolant jacket and flushes out any contaminating air that might have entered the system. For example, during prolonged high speed/load operation (zone C of FIG. 5) since sub-atmospheric conditions are apt to prevail, a small amount of air may enter the system. If the volume becomes excessive and/or finds its way into the radiator it may be necessary to execute a "hot purge". This control will be dealt with in connection with FIG. 24 hereinlater. To distinguish the instant operation and that just mentioned, the instant mode may be deemed to be "cold purge".

In more detail, at step 1401 timer 1 is cleared and in step 1402 the system is conditioned as shown. In this state upon the program going to step 1403 coolant is inducted from reservoir 226 by heater circulation pump 276 via conduit 280 and valve 278 and forced into the coolant jacket 208 through heater return conduit 274. As the cooling circuit should be essentially full at this temperature, the excess coolant in the circuit soon overflows out through conduit 246 and valve 248.

Upon the count of timer 1 exceeding a period of 60 seconds (in this embodiment) the operation of the pump is stopped (step 1405).

WARM-UP CONTROL ROUTINE

Figure 13:
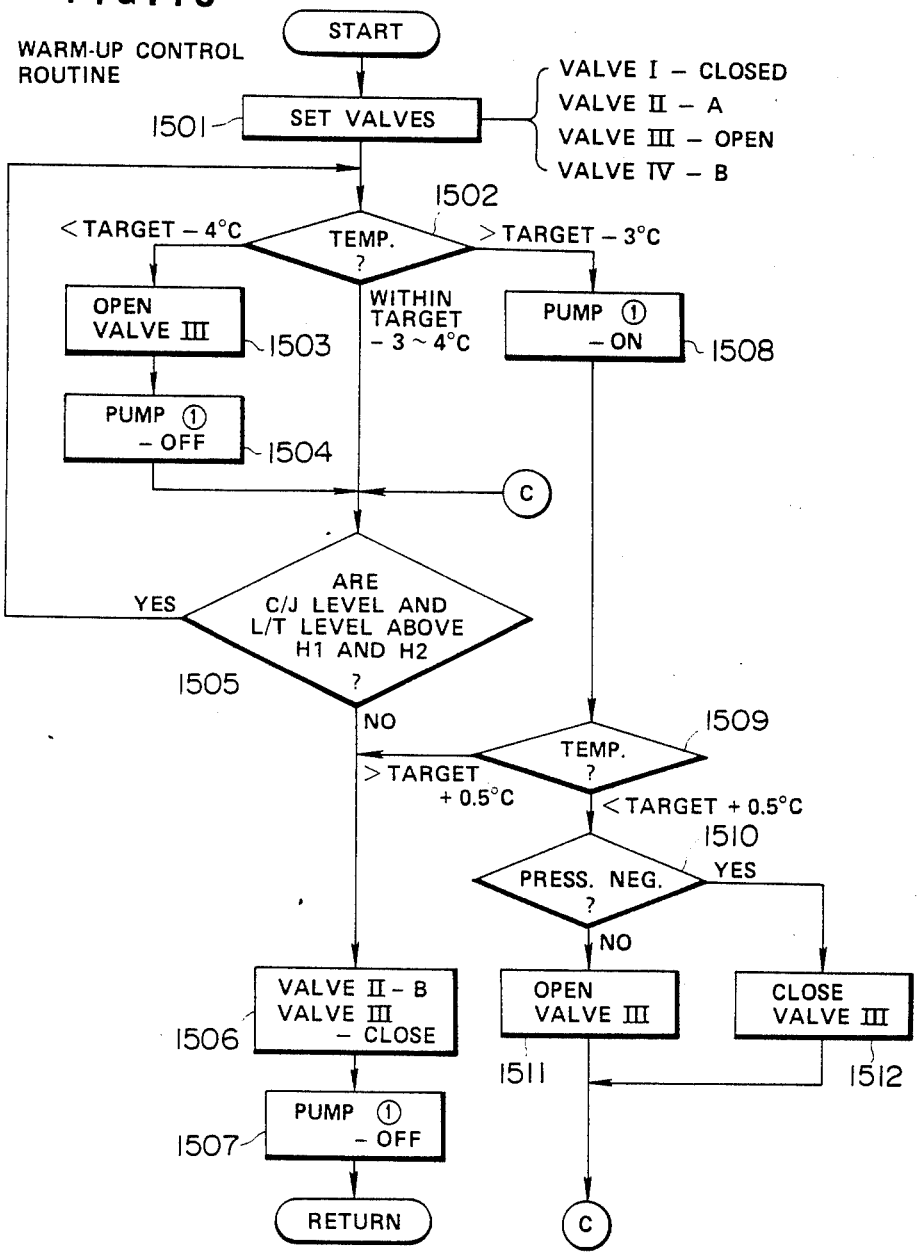

As shown in FIG. 13 the first step (1501) of this routine conditions the system as indicated. This, as will be appreciated, changes the system from a state wherein coolant can be positively pumped into the system into one wherein coolant can be displaced out thereof. Viz., valve I (276) is closed cutting communication between the vapor manifold 212 and the reservoir 226 via conduit 246; valve II (290) is conditioned to produce flow path A and thus establish fluid communication between the output port of coolant return pump 224 and the reservoir 226 via conduit 239; valve III (230) is opened to establish communication between the lower tank 220 and the reservoir 226 via conduit 228; and valve IV (278) is conditioned to establish flow path B in the heating circuit.

At step 1502 the instant temperature is ranged and in the event that the temperature is found to be on the low side (below TARGET—4° C.) then the program goes to step 1503 wherein a command which ensures that valve III is open, is issued. At step 1504 return pump 224 is stopped. Under these conditions the system is conditioned so that the vapor pressure which is inevitably generated in the coolant jacket displaces coolant out of the cooling circuit via valve III (230).

At step 1505 the outputs of level sensors 254 and 262 are both read. Until one indicates a low level the program recycles to step 1502.

On the other hand, if the temperature is found to be within a predetermined range of TARGET then the program flows directly from step 1502 to step 1505. However, in the event that the temperature is on the high side of the desired value (greater than TARGET—3° C.) then to avoid overheating due to high pressure/temperature conditions, pump 1 (coolant return pump 224) is energized. Under these conditions since valve II (290) has been set to produce flow path A, this energization positively pumps coolant out of the cooling circuit.

At step 1509 the temperature of the coolant is again ranged. In the event that this ranging indicates that the temperature is only slightly on the high side then the program flows to step 1506 wherein valve II (290) is set to establish flow path B and and close valve III (230). This of course conditions the system to assume a closed circuit state so that coolant return pump 224 is fluidly communicated with the coolant jacket 208 and thus able to pump coolant thereinto. At step 1507 a command to stop the operation of the coolant return pump 224 is issued.

In the event that the temperature ranging in step 1509 indicates that the coolant temperature is slightly below TARGET then at step 1510 the output of pressure sensor 250 is read. In the event the pressure in the coolant jacket 208 is in fact negative then the program flows to step 1512 wherein a command is issued to ensure that valve III (230) is closed and unwanted re-induction of coolant is not permitted at this stage. On the other hand, if the pressure is not negative then valve is conditioned to assume an open state in step 1511.

Following steps 1511 and 1512 the program recycles to step 1505 and the instant levels in the coolant jacket 208 and lower tank 220 and again checked.

COOLANT JACKET LEVEL CONTROL ROUTINE (I)

FIG. 14 shows the steps which characterize a first level control sub-routine of the instant embodiment. As shown at step 1601 the output of level sensor 254 is sampled and in the event that an insufficent amount of coolant is determined to be contained in the coolant jacket 208 then at step 1602 coolant return pump 224 is energized. Following this a first coolant jacket level check sub-routine is run at step 1603.

However, in the event that step 1601 indicates an adequate level of coolant is present in the coolant jacket (viz., at or above level H1) then at step 1604 the coolant return pump 224 is stopped, valve III (230) is closed and valve IV (278) is set to establish flow path B. At step 1605 it is determined if the a demand for cabin heating exists. In the event that such a demand does not exist then at step 1608 heater circulation pump 276 is stopped.

However, if the demand for heating exists then at steps 1606 and 1607 timer 5 is cleared and a command which permits the second interrupt routine to be run is issued to cancel any contrary command which might have been issued during another routine and which is still in force.

Following steps 1603 and 1607 the instant routine returns.

COOLANT JACKET LEVEL CHECK ROUTINE (I)

FIG. 15 shows the steps executed in the sub-routine run is step 1603 of the first coolant jacket control routine discussed hereinabove.

In the first step of this routine timer 5 is set counting. While the count of this timer remains below 10 seconds the program returns. However, upon the count indicating that a period of between 10 and 20 seconds has elapsed it is deemed that cavitation or the like trouble has occured and the program after issuing a command to prevent the running of the second interrupt routine at step 1702 goes to step 1703 wherein the output of the pressure sensor 250 is read.

In the event that it is determined that the pressure in the cooling circuit is in fact negative, then at step 1708 valve III (230) is opened to establish fluid communication between the reservoir 226 and the lower tank 220 to permit fresh cool coolant to be inducted. However, if the pressure is found to be positive then the program goes to step 1704 wherein valve IV (276) is set to establish flow path A and circulation pump 276 is energized. This of course inducts fresh coolant from the reservoir 226 and positively pumps same into the coolant jacket. This suppresses possible cavitation.

At step 1705 the level of coolant in the lower tank 220 is determined and in the event that is above H2 then valve III (230) is opened. Since the pressure in the cooling circuit is positive at this point (see step 1703) hot coolant is discharged from the lower tank 220 out to the reservoir 226. However, if the level should be found to be lower than H2 a command to close valve III is issued to prevent excessive discharge from the system.

With this procedure, in the event that cavitation is occuring, as is highly likely if the coolant return pump 224 is continuously energized for more than 10 seconds, the switch to the use of the heater pump ensures that the vital minimum amount of coolant in the coolant jacket is maintained and prevents cavitation therein. Further, the circuit is rendered open circuit in the event that a positive pressure has developed which permits a heated portion of the increased amount of coolant in the cooling circuit to be displaced out of the system under the influence of the same.

COOLANT JACKET LEVEL CONTROL ROUTINE (II)

Figure 16:
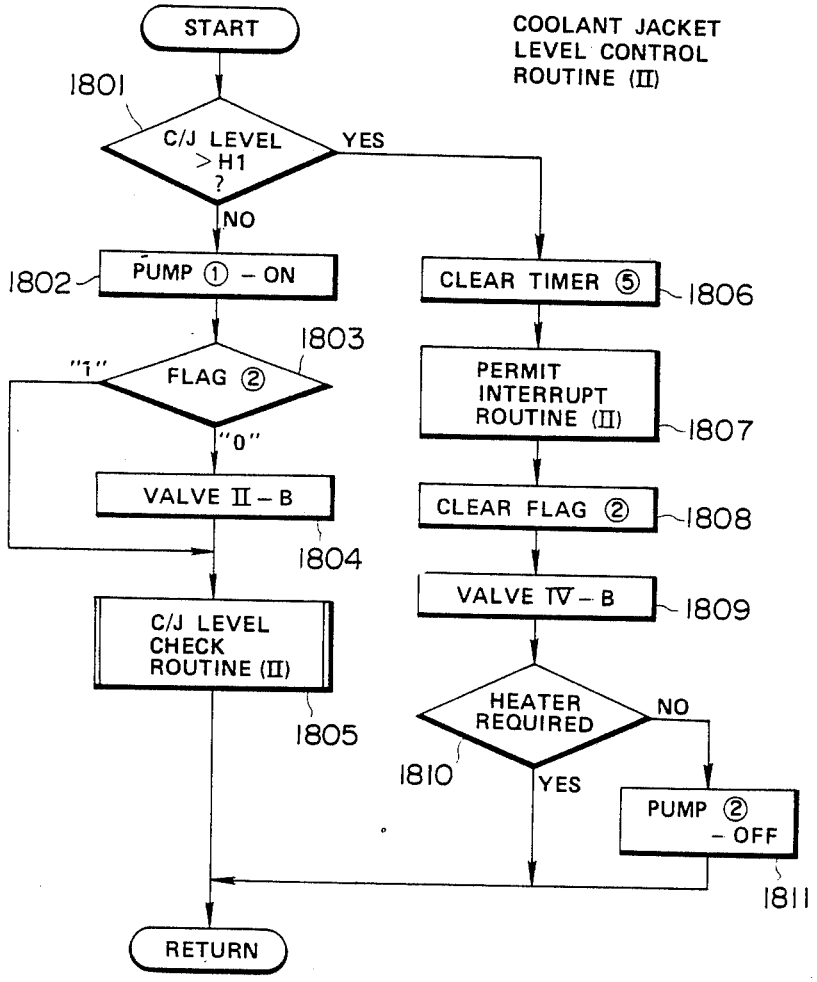
Figure 17:
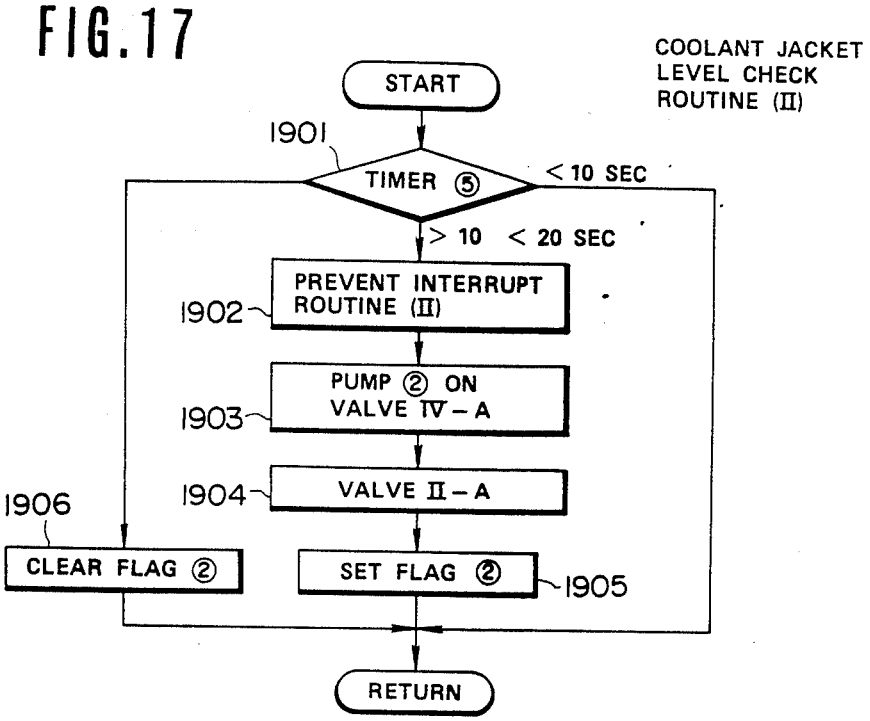

FIG. 16 shows a second coolant jacket control routine which is run at step 1123 of the system control routine (FIG. 11B) following a determination that the level of coolant in the lower tank 220 is above level H2. The first step of this routine is to determine the level of the coolant in the coolant jacket 208. In the event that the level of liquid is found to be below H1, the program flows to step 1802 wherein a command to energize the coolant return pump 224 is issued and at step 1803 the current status of FLAG 2 is checked. If the flag has been set to "1" then the program by-passes step 1804. On the hand, if the status of FLAG 2 is "0" then the program conditions valve II (290) to produce flow path B. At step 1804 a second coolant jacket check routine is run. The nature of this routine will be set forth hereinlater.

In the event that the enquiry carried out in step 1801 indicates that the level of coolant in the coolant jacket 208 is in fact sufficient (i.e. is above level H1) then at step 1806 timer 5 is cleared and at step 1807 the control circuit 256 is conditioned to permit the second interrupt routine to be run. At step 1808 FLAG 2 is cleared (set to "0") and at step 1809 valve IV (278) is conditioned to establish flow path B.

At step 1801 the requirement for cabin heating is determined and in the event that such is not in demand then at step 1811 a command to stop the circulation pump 278 is issued.

Following steps 1805, 1810 and 1811 the instant program returns.

COOLANT JACKET LEVEL CHECK ROUTINE (II)

The first step of this routine (FIG. 17) is to check the count of timer 5 and range the same. While the count is below 10 seconds the program returns, however upon a 10 second limit being exceeded and remaining below a second limit of 20 seconds, the program flows to step 1902 wherein a command which prevents the running of the second interrupt routine is issued. At step 1903 valve IV (278) is set to establish flow path A (viz., connect the reservoir 226 and the induction port of heater circulation pump 276) and energizes said pump. As will be understood these steps are executed in the anticipation that, since the coolant return pump 224 has been continuously energized for some time, it is likely that a malfunction or cavitation has occured.

At step 1904 valve II (290) is conditioned to produce flow path A wherein the discharge port of the coolant return pump 224 is fluidly connected with the reservoir 226 via conduit 292 and at step 1905 the current status of FLAG 2 is revised to assume a value of "1".

In the event that the count of timer 5 exceeds the 20 second limit the program flows to step 1906 wherein FLAG 2 is cleared (set to "0") so as to ensure that during the running of the second coolant jacket control routine, valve II (290) will be set to establish flow path B following a prolonged attempt to re-establish level H1 and thus prevent the possibility of displacement of coolant out of the cooling circuit at a time when a serious shortage of the same may have occured. Further, at this point it is possible to deem that a serious problem has occured and issue a warning to the vehicle operator if so desired.

Following steps 1905 and 1906 the second check routine returns.

CONDENSER LEVEL REDUCTION CONTROL ROUTINE

Figure 18:
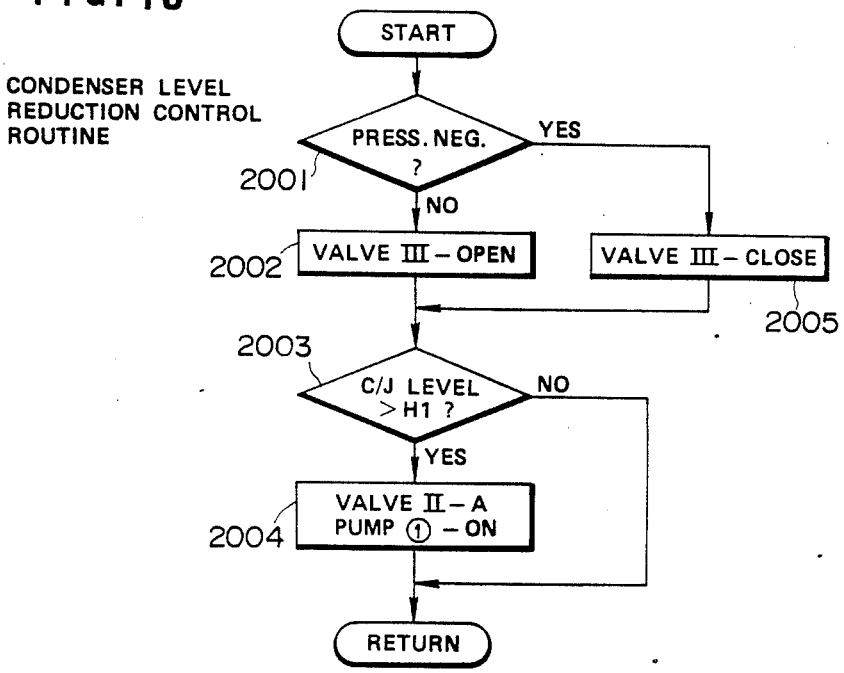
Figure 19:
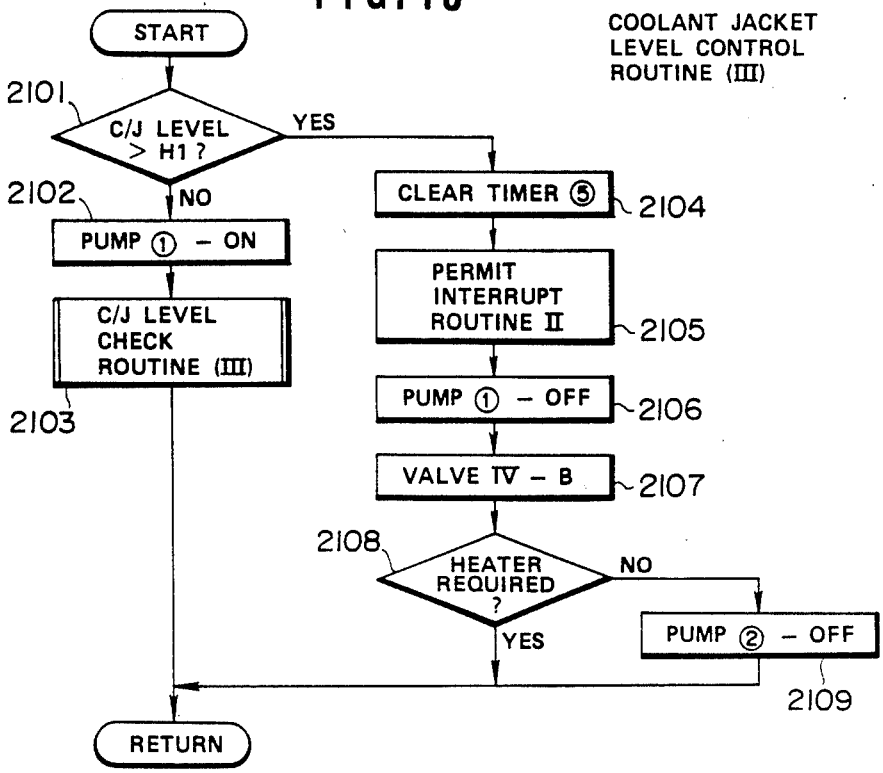

FIG. 18 shows the steps which are implemented in order to lower the level of coolant in the radiator 216 and lower tank 220 to an appropriate level. It will be noted that this routine is run in step 1126 (FIG. 9B) while the count of timer 3 is still less than 1 second or has been cleared in step 1130. It will be also noted that this routine is run after the running of the second coolant jacket level control routine wherein if it is possible that fresh coolant from the reservoir has been pumped into the coolant circuit via the heater circulation pump 278 and thus the total volume of coolant in the cooling circuit has been increased.

The first step of this routine is to read the output of the pressure sensor 250 and determine if the pressure prevailing in the cooling circuit is above or below the presure at which the sensor is triggered to indicate a sub-atmospheric pressure. If the pressure is negative, then at step 2005 a command which closes valve III (230) and ensures that the system remains closed circuit under such circumstances, is issued. However, if the pressure is positive, then at step 2002 valve III (230) is opened to permit the displacement of coolant from the lower tank 220 out to the reservoir 226. At step 2003 the instant status of the coolant jacket level is checked and in the event that the level is found to be adequate, then at step 2004 valve II (290) is switched to flow path A and the coolant return pump 224 is energized to positively extract coolant from the lower tank 220 and force the same out to the reservoir 226. It will be noted that the combination of the positive introduction via heater circulation pump 278 (in the event that return pump has been operated for an abnormally long period) in the second coolant level control and check routines, followed by this positive removal of hot coolant from the lower tank 220 is beneficial from the point of preventing cavitation in the coolant jacket 208 and provides for the failure of the coolant return pump 224.

However, in the event that the enquiry performed in step 2003 indicates that the level of coolant in the coolant jacket 208 is not above H1 then step 2004 is bypassed to avoid depleting the supply of liquid coolant in the cooling circuit. It will also be noted that if appropriate, the conditioning which will occur in the event that step 2004 is effected will be appropriately reversed at step 1132 of the system control routine.

COOLANT JACKET LEVEL CONTROL ROUTINE (III)

This routine is run in the event that the temperature of the coolant is ranged on the low side in step 1120 of the system control routine. The first step is to read the output of level sensor 252 to determine if the level of coolant in the coolant jacket 208 is above H1 or not. If not, at steps 2102 and 2103 the coolant return pump 224 is energized and a third coolant jacket level check routine run.

However, if the outcome of the enquiry at step 2101 is positive then at steps 2104 and 2105 timer 5 is cleared and permission for the second interrupt routine to be run is issued. At steps 2106 and 2107 the operation of the return pump 224 is stopped and valve IV (278) set to permit cabin heating. At step 2108 the requirement for cabin heating is checked and if not demanded, the operation of the circulation pump 278 is stopped at step 2109.

COOLANT JACKET LEVEL CHECK ROUTINE (III)

Figure 20:
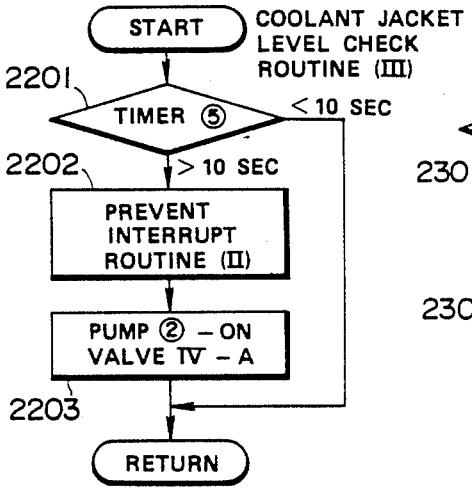
Figure 21:
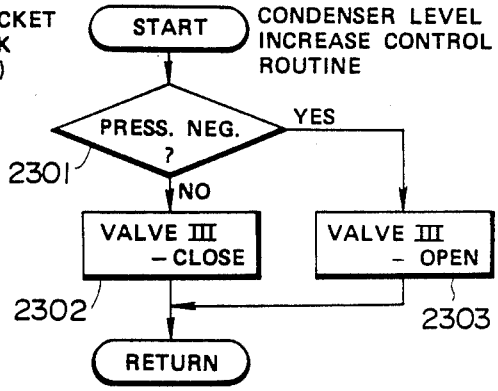

As shown in FIG. 20 the first step of this routine is to check the count of timer 5. While the count remains below 10 seconds the program returns. However, upon exceeding this limit, commands to prevent the running of the second interrupt routine, to energize the heater circulation pump 278 and to set valve IV (278) to flow path A are issued. This of course by-passes the control of the coolant return pump and tends to fill the cooling circuit with additional fresh cool coolant in a manner which increases the pressure prevailing therein and thus modifies the boiling point of the coolant. This introduction also quells cavitation in the coolant jacket.

CONDENSER LEVEL INCREASE CONTROL ROUTINE

As will be appreciated from FIG. 9B this routine is run following the third coolant jacket level control routine and in the event the count of timer 2 is outside of a 3–4 second range.

The first step of this routine is to check the pressure status in the cooling circuit by reading the output of pressure sensor 205. When the pressure is negative, valve III (230) is permitted to open and coolant is allowed to be inducted into the lower tank 220. This reduces the pressure differential between the interior of the system and the ambient atmosphere and also tends to reduce the surface area of the radiator 216 which is available for latent heat release. Both of these measures help to raise the temperature of the coolant toward the desired TARGET level.

ABNORMALLY HIGH TEMPERATURE CONTROL ROUTINE

Figure 22A:
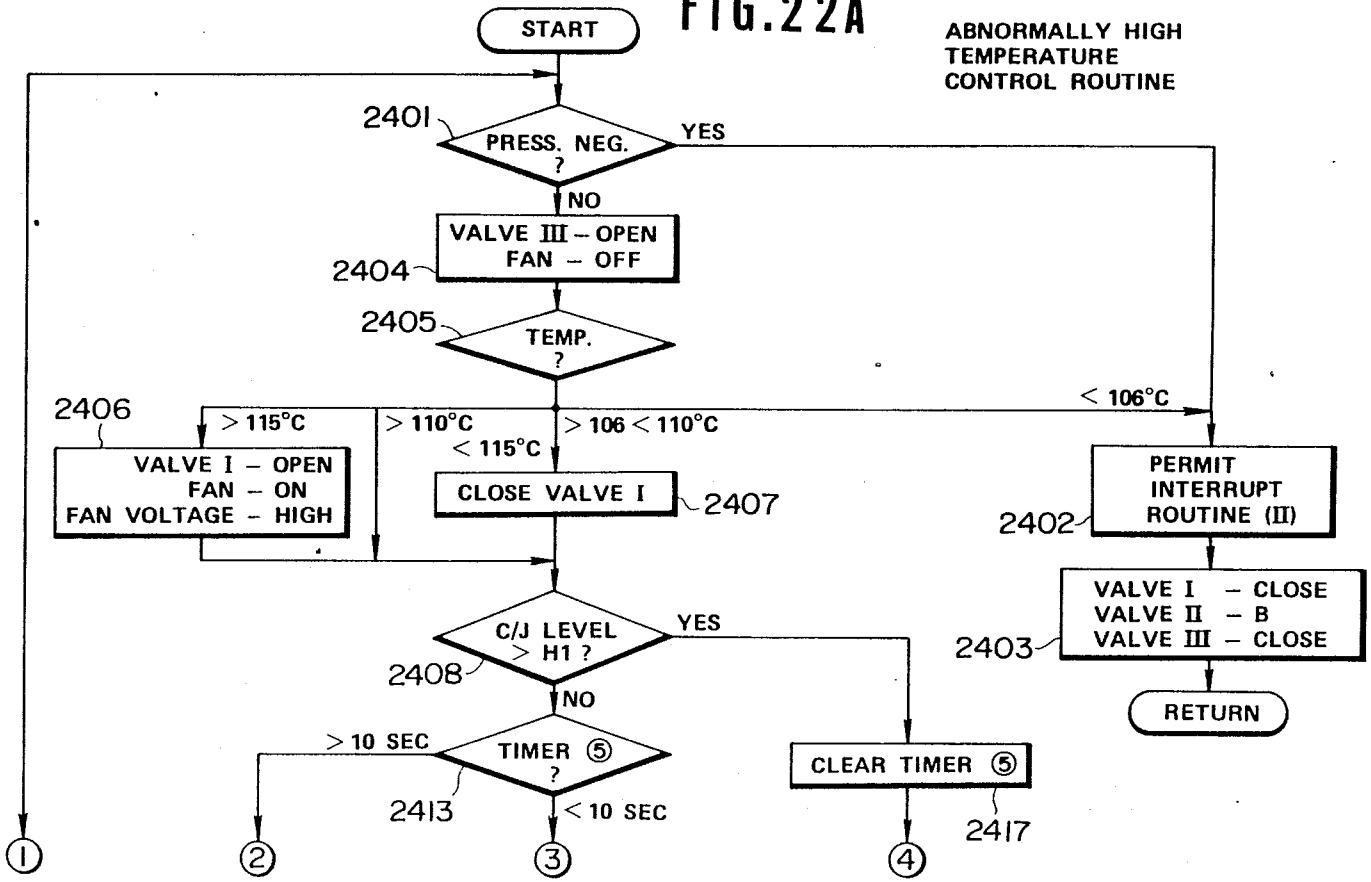
Figure 22B:
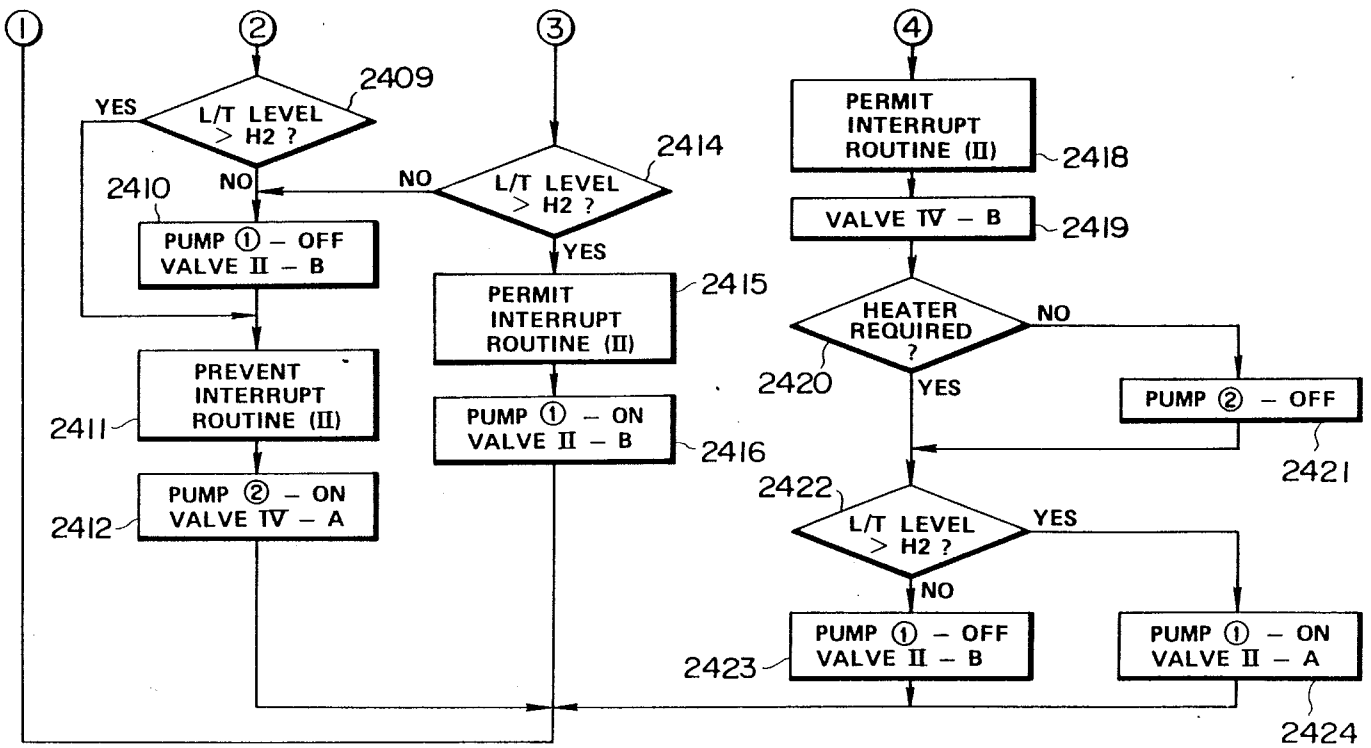

FIG. 22 shows a routine which is run in the event that a possible engine overheat situation is sensed. The first step of this routine is to ascertain the instant pressure conditions within the cooling circuit. In the event that the pressure within the cooling circuit is negative, the program flows across to steps 2402 and 2403 wherein commands are issued to permit the second interrupt routine to be run and for the system to be conditioned to assume a closed state wherein valve II (290) is set to establish flow path B.

On the other hand, in the event that the pressure in the system is positive, as would be expected with the temperature at or above 110° C., the program flows to step 2404 wherein valve III (230) is opened and the cooling fan 218 is stopped. This condition of course permits pressurized coolant vapor to suddenly flow down through the radiator 216 toward and into the lower tank 220 and thus flush out ("hot purge") any pocket of air or the like which may be blocking the radiator 216 and inducing the abnormally high temperatures. The pressure in the system drops rapidly due to this venting. At step 2405 the coolant temperature is ranged.

In the event that the temperature is found to be above 115° C. then at step 2406 valve I (248) is opened and the cooling fan 218 is switched on at maximum power. These measures permit excess pressure to be vented out of the system via the overflow conduit 246. As will be noted in FIG. 8 in this embodiment overflow conduit 246 is connected with a lower section of the reservoir 226 and thus defines a kind of "steam trap" which condenses most of the vapor which bubbles through the coolant stored therein under such conditions. Further, with the sudden reduction in pressure the strong fan operation tends to very rapidly lower the temperature of the coolant to a somewhat safer level.

In the event that the temperature falls in or drops within a range of 110° C. to 115° C. then step 2406 s by-passed and the program goes directly to step 2408. However, if the temperature is found to be in a range of from 106° C. to 110° C. then at step 2407 valve I (248) is closed to terminate the venting of the coolant vapor from the upper section of the cooling circuit.

At step 2408 the level of coolant in the coolant jacket 208 is checked. If the level is found to be insufficient then at step 2409 the count of timer 5 is checked. If the count corresponds to a time of less than 10 seconds then at step 2414 the level of coolant in the lower tank 220 is checked. If the level is above H2 then at step 2415 the second interrupt routine is permitted and at step 2416 the coolant return pump 224 is energized with valve II (290) set to establish fluid communication between said pump and the coolant jacket 208.

However, if at step 2413 the count of timer 5 is found to indicate a period of more than 10 seconds, the program flows across to step 2409 wherein the output of level sensor 262 is checked. If the level of coolant in the lower tank 220 is above H2 then step 2410 is by-passed. On the other hand, if the level is not above H2 then at step 2410 the coolant return pump 224 is stopped and valve II (290) is set to establish flow path B. If at step 2414 the level of coolant in the lower tank 220 is found to be inadequate the program executes step 2310.

In the event that the enquiry performed in step 2408 indicates that the level of coolant in the coolant jacket 208 is above H1 then the program flows to steps 2417 through 2420 and 2421 in the event that cabin heating is not required.

At step 2422 the level of coolant in the lower tank 220 is again checked. In accordance with the outcome of this enquiry the system is conditioned according to one of steps 2423 and 2424. Viz., if an excess of coolant is found to be present in the lower tank 220 the system is conditioned to pump it out. Viz., since the instant coolant temperature is still in the order of 106° C. and the instant program is designed to control an overheat situation, removal of coolant from the lower tank 220 facilitates this end by removing coolant from the cooling system in a manner which tends to maximize the amount of surface area in the radiator 216 available for latent heat release.

The program recycles until such time as the pressure in the system becomes negative or until the temperature drops below 106° C. Upon either of these requirements being met it is deemed that the overheat problem has been solved and that normal control can be resumed.

What is claimed is:

1. In an internal combustion engine having a structure subject to high heat flux;

a cooling system for removing heat from said engine comprising:

a cooling circuit including:

a coolant jacket disposed about said structure and into which coolant is introduced in liquid form, permitted to boil and discharged in gaseous form;

a temperature sensor disposed in said coolant jacket for sensing the temperature of the coolant therein;

a radiator in fluid communication with said coolant jacket and in which coolant vapor produced in said coolant jacket is condensed to its liquid form, said radiator having heat exchanging surfaces exposed to a cooling medium;

means for returning liquid coolant from said radiator to said coolant jacket in a manner which maintains the level of coolant in said coolant jacket at a first predetermined level, said first predetermined level being selected to immerse said structure in a predetermined depth of liquid coolant;

a first level sensor disposed in said radiator for sensing the level of liquid coolant being above a second predetermined level;

a device for varying the amount of cooling medium which flows over the heat exchanging surfaces of said radiator;

a control circuit responsive to said temperature sensor and said first level sensor, said control circuit being arranged to energize said device (a) at a first level in response to said temperature sensor indicating that the temperature of the coolant in said coolant jacket is above a desired target value and said level sensor indicating that the level of coolant in said radiator is above said second predetermined level and (b) at a second level in response to said temperature sensor indicating that the temperature of the coolant in said coolant jacket is above a desired target value and the said level sensor indicating that the level of coolant in said radiator is below said second predetermined level.

2. A cooling system as claimed in claim 1, wherein said coolant return means includes:

a coolant return conduit which leads from said radiator to said coolant jacket;

a coolant return pump disposed in said coolant return conduit; and a second level sensor disposed in said coolant jacket for sensing the level of coolant being at said first predetermined level;

said control circuit being responsive to the output of said first level sensor and operatively connected with said coolant return pump in a manner that said pump is selectively energized to pump liquid coolant from said radiator to said coolant jacket when said second level sensor outputs a signal indicating that the level of liquid coolant in said coolant jacket is below said first predetermined level.

3. A cooling system as claimed in claim 1, further comprising:

an auxiliary circuit in fluid communication with said cooling circuit and through which liquid coolant is circulated by a circulation pump;

a source of liquid coolant;

a first conduit which leads from said source to said auxiliary circuit, said conduit communicating with said auxiliary circuit at a location downstream of the cirulation pump; and a first valve, said first valve having a first state wherein fluid communication between said source and said auxiliary circuit is established in a manner that said circulation pump, upon energization, inducts coolant from said source via said first conduit and pumps same into said cooling circuit, and a second state wherein communication between said source and said auxiliary circuit is cut-off and upon energization, said coolant circulation pump circulates coolant through said auxiliary circuit.

4. A cooling system as claimed in claim 3, wherein said control circuit includes means for monitoring the time for which said coolant return pump operates and for causing said first valve to assume said first state and said circulation pump to pump in the event that said coolant return pump operates for more than a predetermined period.

5. A cooling system as claimed in claim 4, wherein said monitoring means maintains said first valve in said first state and the circulation pump pumping until such time as said second level sensor indicates that the level of coolant in said coolant jacket is at said first predetermined level.

6. A cooling system as claimed in claim 1, wherein:

said source of liquid coolant takes the form of a reservoir in which liquid coolant is stored; and wherein;

said first conduit forms part of a valve and conduit means for selectively establishing fluid communication between said reservoir and said cooling and auxiliary circuits.

7. A cooling circuit as claimed in claim 6, wherein said valve and conduit means further comprises:

a second conduit which leads from said reservoir to said coolant circuit, said second conduit communicating with said cooling circuit at a level lower than said first predetermined level;

a second valve disposed in said second circuit and arranged to have a first state wherein communication between reservoir and said cooling circuit is established and a second state wherein the communication is prevented;

a third conduit which leads from said reservoir to said cooling circuit and communicates with said cooling circuit at a level higher than said first predetermined level; and a third valve disposed in said third conduit, said third valve a first state wherein communication between reservoir and said cooling circuit is established and a second state wherein the communication is prevented.

8. A cooling circuit as claimed in claim 7, wherein said valve and conduit means further comprises:

a fourth valve, said fourth valve being disposed in said coolant return conduit at a location between said coolant return pump and said coolant jacket; and a fourth conduit, said fourth conduit leading from said reservoir to said fourth valve, said fourth valve having a first state wherein communication between said pump and said coolant jacket is established and communication between said reservoir and said coolant return conduit is cut-off, and a second state wherein communication between said pump and said coolant jacket is interrupted and communication between said pump and said reservoir is established.

9. A cooling circuit as claimed in claim 7, wherein said valve and conduit means further comprises:

a small collection vessel disposed at the bottom of said radiator for collecting liquid coolant which is formed in said radiator, said first sensor being disposed in said vessel.

10. A cooling system as claimed in claim 9, wherein said second level is selected so that when the level of liquid coolant in said coolant jacket is at said first predetermined level and the level of liquid coolant in said vessel is at said second predetermined level, the minimum amount of coolant which should be retained in cooling circuit is contained therein.

11. A cooling circuit as claimed in claim 9, further comprising a sensor which senses the level of pressure prevailing in said cooling circuit with respect to the ambient atmospheric pressure.

12. A cooling circuit as claimed in claim 10, wherein said control circuit includes means for:

monitoring the time for which said coolant return pump operates and for causing said first valve to assume said first state and said circulation pump to pump in the event that said coolant return pump operates for more than a predetermined period;

maintaining said first valve in said first state and the circulation pump pumping until such time as said second level sensor indicates that the level of coolant in said coolant jacket is at said first predetermined level;

sensing the level of pressure in said coolant jacket;

sensing the level of coolant in said vessel by sampling the output of said second level sensor;

opening said second valve when the level of coolant in said vessel is above said second predetermined level and the pressure in said cooling circuit is positive or when the level of coolant in said vessel is below said second predetermined level and the pressure in said cooling circuit is below atmospheric.

13. A cooling circuit as claimed in claim 12, wherein said control circuit further includes means for:

opening said second valve when the temperature and pressure in said cooling circuit are within a first predetermined range and for:

opening said fourth valve when the temperature in said cooling circuit exceeds a maximum prmissible limit.

14. A method of cooling an internal combustion engine having a structure subject to high heat flux comprising the steps of:

introducing liquid coolant into a coolant jacket disposed about said structure;

permitting the coolant to absorb heat from said structure, boil and produce coolant vapor;

condensing the coolant vapor produced in said coolant jacket to its liquid form in a condenser;

returning the liquid condensate formed in said radiator to said coolant jacket using coolant return means in a manner to maintain the level of liquid coolant in said coolant jacket at a first predetermined level which is selected to maintain the structure immersed in a predetermined depth of liquid coolant;

sensing the temperature of the coolant in said coolant jacket;

sensing the level of coolant in said radiator at a second predetermined level;

using a device to vary the rate of heat exchange between the heat exchanging surfaces of said radiator and a cooling medium;

controlling said device in response to the temperature of the coolant in said coolant jacket and in response to the level of liquid coolant in said radiator; and controlling said device to operate (a) in a first mode when the temperature of the coolant in said coolant jacket is above a desired target value and the level of liquid coolant in said radiator is above said second predetermined level, and (b) in a second mode when the temperature of the eoolant in said coolant jacket is above said desired target level and the level of coolant in said coolant jacket is at or below said second predetermined level.

15. A method as claimed in claim 14, wherein said device takes the form of a cooling fan and wherein said first mode takes the form of energizing said fan at a first power level and wherein said second mode takes the form of operating said fan at a second power level, said second power level being higher than the first one.

16. A method of cooling an internal combustion engine having a structure subject to high heat flux comprising the steps of:

introducing liquid coolant into a coolant jacket disposed about said structure;

permitting the coolant to absorb heat from said structure, boil and produce coolant vapor;

condensing the coolant vapor produced in said coolant jacket to its liquid form in a condenser;

returning the liquid condensate formed in said radiator to said coolant jacket using coolant return means in a manner to maintain the level of liquid coolant in said coolant jacket at a first predetermined level which is selected to maintain the structure immersed in a predetermined depth of liquid coolant;

sensing the temperature of the coolant in said coolant jacket;

sensing the level of coolant in said radiator at a second predetermined level;

using a device to vary the rate of heat exchange between the heat exchanging surfaces of said radiator and a cooling medium;

controlling said device in respone to the temperature of the coolant in said coolant jacket and in response to the level of liquid coolant in said radiator;

circulating coolant from said coolant jacket through an auxiliary circuit using a circulation pump;

monitoring the operation of said coolant return means; and connecting the circulation pump with a source of liquid coolant and energizing the circulation pump in the event that an operational characteristic of said coolant return means falls outside of a predetermined schedule so as to pump liquid coolant from said source into said coolant jacket.

17. A method as claimed in claim 16, further comprising:

monitoring the level of coolant in said coolant jacket; and controlling the introduction of liquid coolant from said source via the circulation pump in response to the monitored level of coolant in said coolant jacket.

18. A method as claimed in claim 16, further comprising:

displacing condensate from the bottom of said radiator to said source using a positive pressure in said radiator.

19. A method as claimed in claim 18, further comprising:

inducting coolant from said source at the bottom of said radiator using a negative pressure in said radiator in a manner to reduce the temperature of the liquid coolant returned to said coolant jacket by said coolant return means.

20. A method as claimed in claim 19, further comprising:

introducing the discharge of said circulation pump into said coolant jacket at a location proximate the structure subject to high heat flux.

21. A method as claimed in claim 20, further comprising:

venting coolant vapor from a location proximate the bottom of said radiator in the event that the temperature and pressure in said coolant jacket are in a first predetermined range.

22. A method as claimed in claim 21, further comprising:

venting coolant vapor from a location proximate the highest section of said coolant jacket in the event that the temperature in said coolant jacket is above a maximum permissible limit.

* * * * *